United States Patent [19]

Yamada et al.

[11] Patent Number: 4,766,467

[45] Date of Patent: Aug. 23, 1988

[54] ELECTROSTATIC COPYING APPARATUS AND AUXILIARY UNIT CAPABLE OF BEING DETACHABLY MOUNTED THEREON

[75] Inventors: Shuji Yamada, Kobe; Tetsuya Matsushita; Hironori Andou, both of Osaka, all of Japan

[73] Assignee: Mita Industrial Co. Ltd., Osaka, Japan

[21] Appl. No.: 933,506

[22] Filed: Nov. 21, 1986

[30] Foreign Application Priority Data

Nov. 28, 1985 [JP] Japan ..... 60-266131
Nov. 30, 1985 [JP] Japan ..... 60-269819

[51] Int. Cl.[4] ..... G03G 15/00

[52] U.S. Cl. ..... 355/14 SH; 355/23; 271/3.1; 271/4

[58] Field of Search ..... 355/3 SH, 14 SH, 24, 355/26, 23; 271/3.1, 4

[56] References Cited

U.S. PATENT DOCUMENTS

| | | | |
|---|---|---|---|
| 4,453,819 | 6/1984 | Wada et al. | 355/3 SH |
| 4,475,806 | 10/1984 | Daughton et al. | 355/14 R |
| 4,527,885 | 7/1985 | Ayata et al. | 355/3 R |
| 4,534,643 | 8/1985 | Watanabe | 355/3 SH |
| 4,674,866 | 6/1987 | Tanaka | 355/14 SH |

*Primary Examiner*—Patrick R. Salce
*Assistant Examiner*—Judson H. Jones
*Attorney, Agent, or Firm*—Beveridge, DeGrandi & Weilacher

[57] ABSTRACT

An electrostatic copying apparatus and an auxiliary unit detachably mounted on the electrostatic copying apparatus to diversify the mode of image formation. The electrostatic copying apparatus includes a paper conveying passage, a paper feed means for feeding paper to the paper conveying passage and a paper feed passage having its downstream end connected to the paper conveying passage, and a copied image is formed on one surface of paper while it is conveyed through the paper conveying passage after being introduced into the conveying passage from the paper feed means or the paper feed passage. The auxiliary unit includes a paper moving passage whose upstream end is to be selectively connected to the downstream end of the paper conveying passage of the copying apparatus and a paper stock means whose upstream end is connected to the downstream end of the paper moving passage and whose downstream end is connected to the upstream end of the paper feed passage of the copying apparatus. The copying paper introduced into the paper conveying passage from the paper feed means in the electrostatic copying apparatus and conveyed through the paper conveying passage is selectively introduced into the paper moving passage of the auxiliary unit and then fed into the paper stock means of the auxiliary unit. Thereafter, the paper is introduced into the paper conveying passage of the copying apparatus from the paper stock means via the paper feed passage of the copying apparatus.

47 Claims, 16 Drawing Sheets

Fig. 12-A
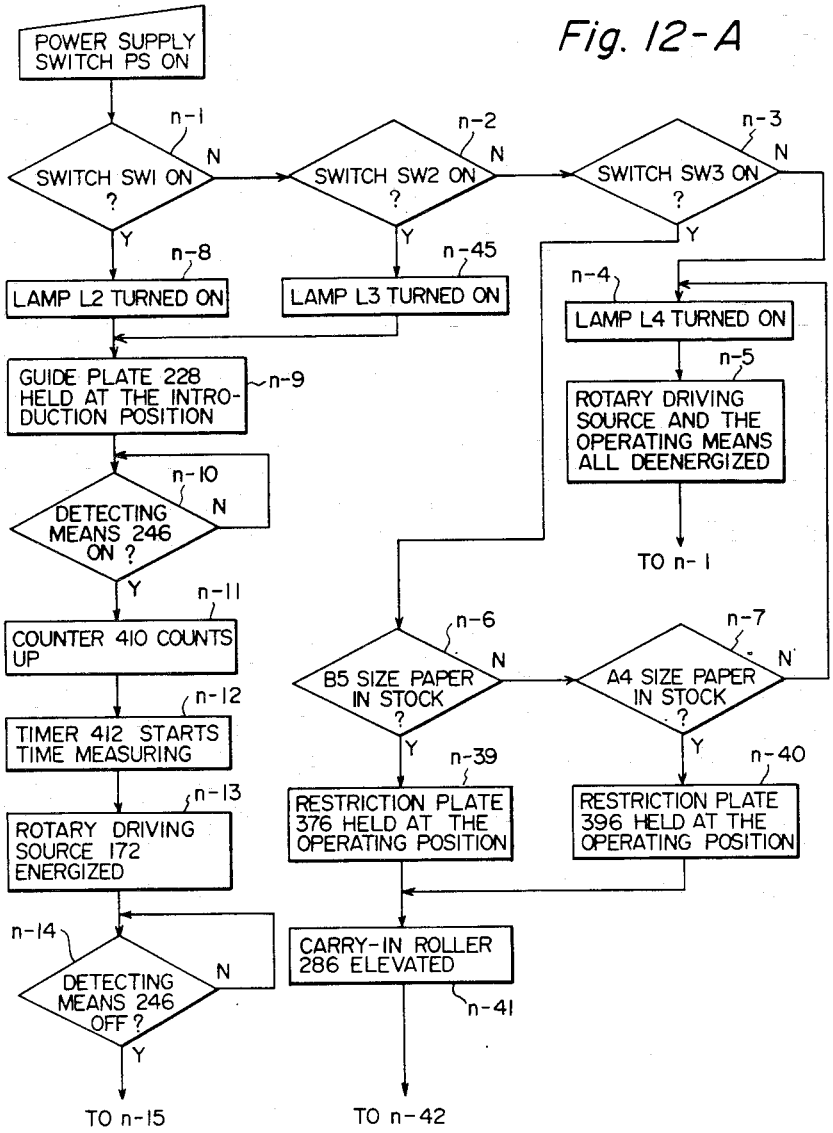

Fig. 12-B
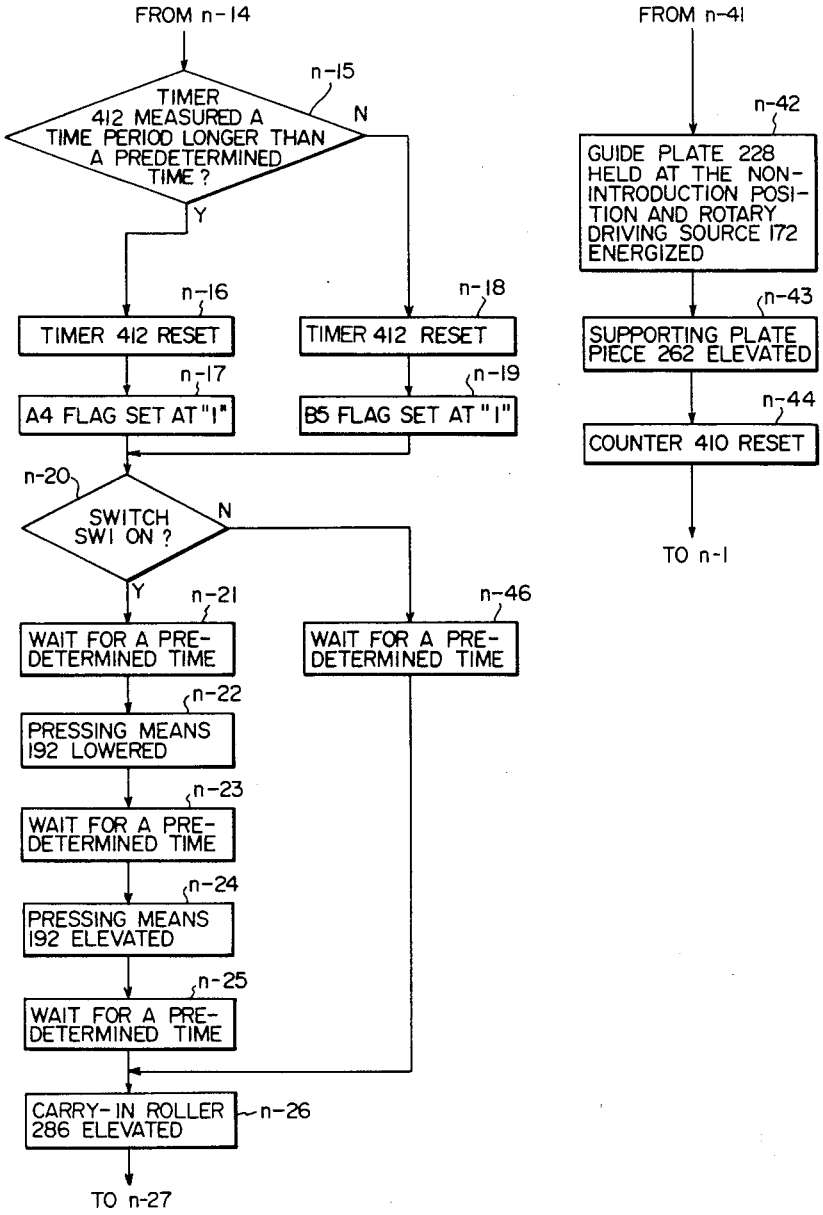

Fig. 12-C
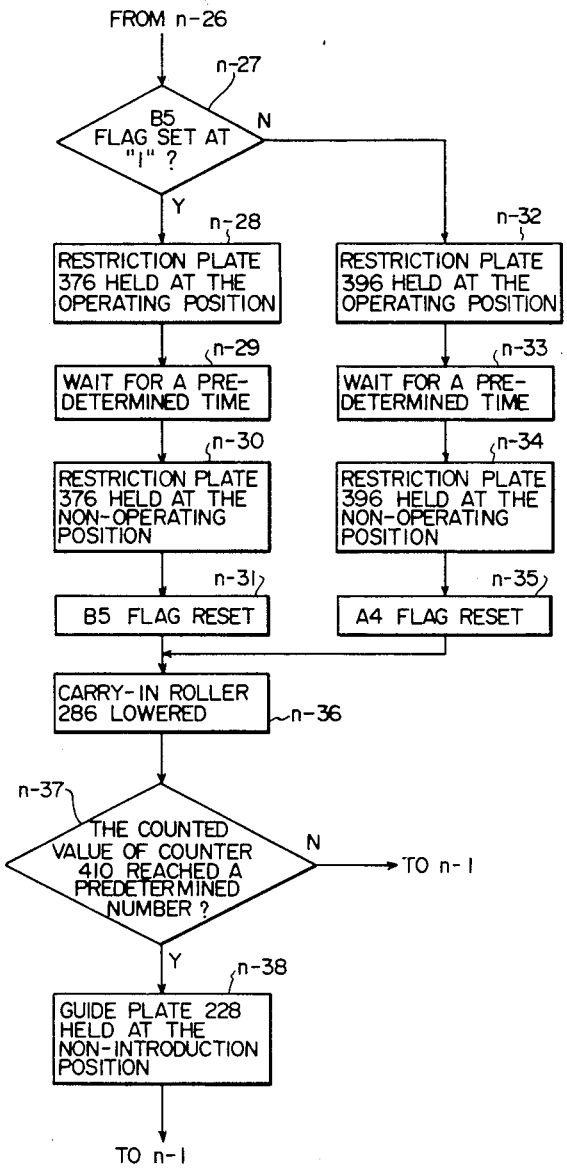

Fig. 14-A
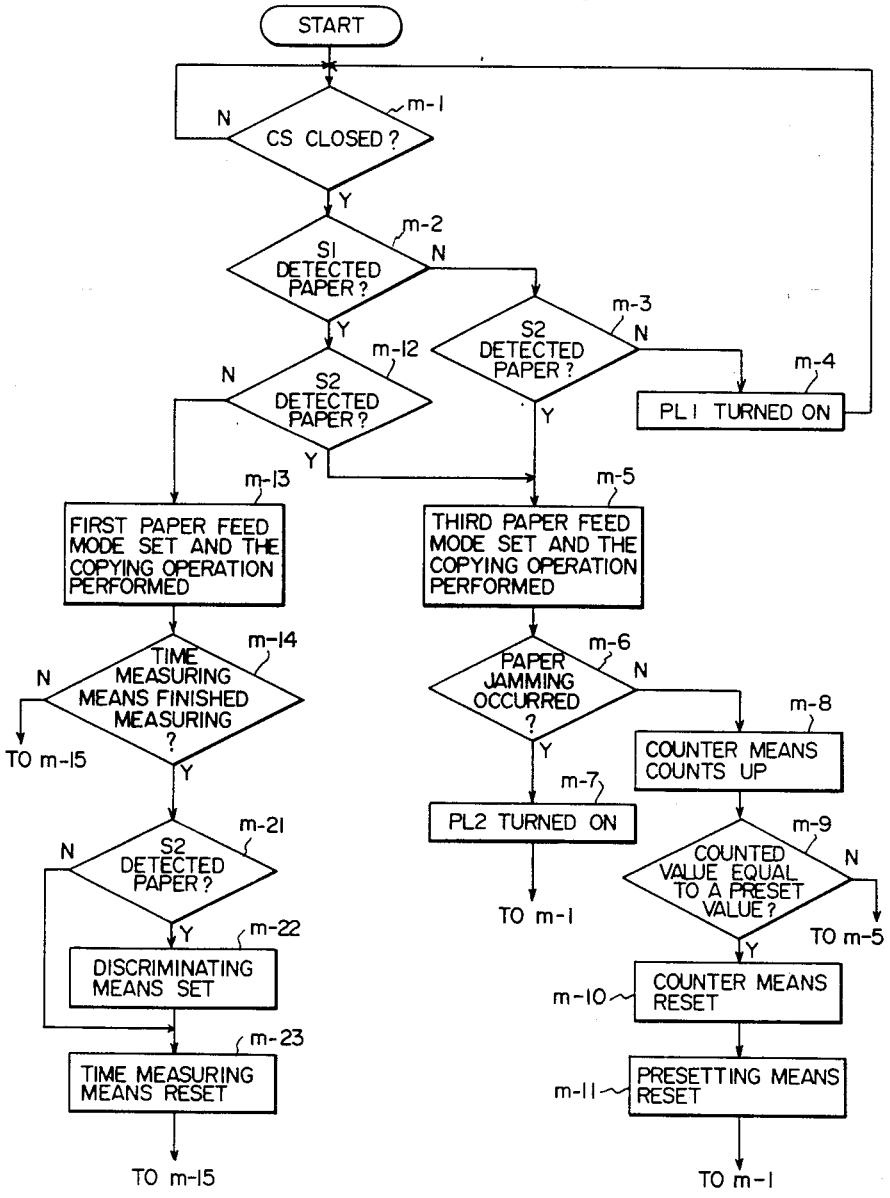

Fig. 14-B
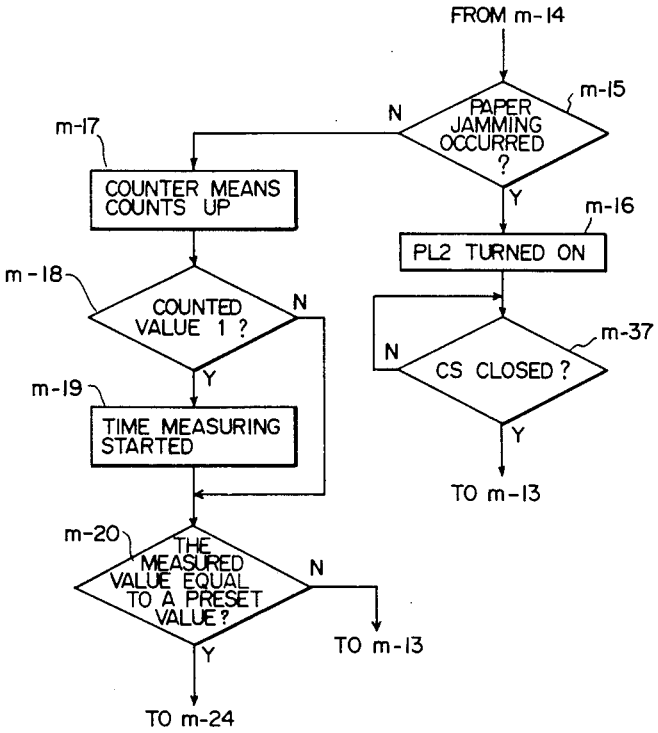

Fig. 14-C
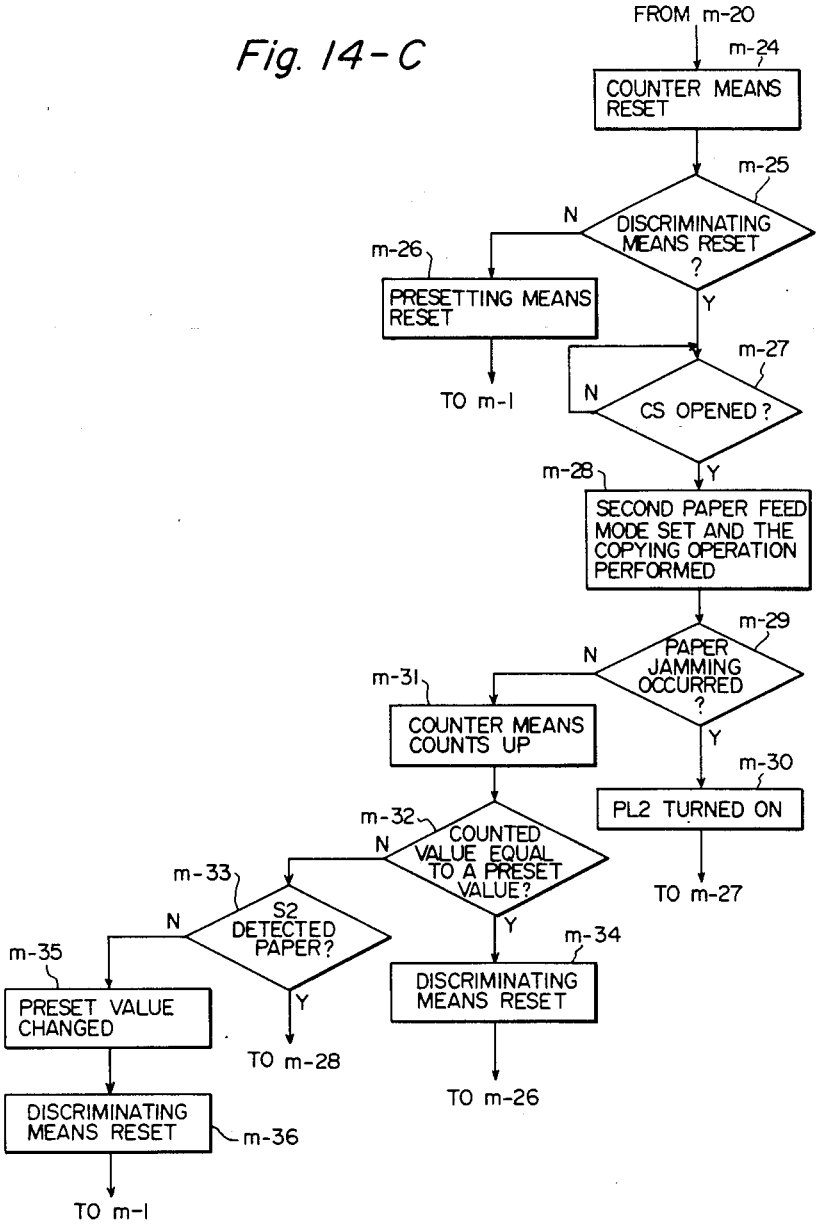

ELECTROSTATIC COPYING APPARATUS AND AUXILIARY UNIT CAPABLE OF BEING DETACHABLY MOUNTED THEREON

BACKGROUND OF THE INVENTION

1. Field of the Invention

This invention relates to an electrostatic copying apparatus and an auxiliary unit to be mounted detachably on it. More specifically, this invention pertains to an electrostatic copying apparatus and an auxiliary unit which is detachably mounted on it and can diversify the mode of forming a copied image.

2. Description of the Prior Art

As is well known to those skilled in the art, "multimode" electrostatic copying apparatuses have recently been proposed and come into commercial acceptance which can selectively perform an ordinary copying mode (the mode whereby a copied image of a single document is formed on one surface of a copying paper), and a both surface copying mode (the mode whereby a copied image of a document is formed on one surface of a copying paper and then a copied image of another document is formed on the other surface of the paper) and/or an overlapping copying mode (the mode whereby a copied image of a document is formed on one surface of a copying paper and then a copied image of another document is overlappingly formed on the aforesaid one surface of the paper).

Conventional multimode electrostatic copying apparatuses, however, have various problems to be solved. The conventional multimode electrostatic copying apparatuses are equipped with various elements for selectively performing the both surface copying mode and/or the overlapping copying mode in addition to the ordinary copying mode as parts essential to the apparatus itself. In the electrostatic copying apparatus market, there is a first demand for multimode electrostatic copying apparatuses which can selectively perform the both surface copying mode and/or the overlapping copying mode in addition to the ordinary copying mode and are relatively expensive, and there is also a second demand for "single mode" electrostatic copying apparatuses which can perform the ordinary copying mode and are relatively inexpensive. The conventional multimode electrostatic copying apparatuses can meet the first demand but cannot meet the second demand. The manufacturers and sellers, therefore, should manufacture and sell the single mode electrostatic copying apparatuses meeting the second demand separately from the multimode apparatuses. This complicates a control of manufacture and stock of apparatuses and entails an increase in cost. The consumer initially purchases a single mode electrostatic copying apparatus with which he is fully satisfied, but when a need arises later to perform the both surface copying mode and/or the overlapping copying mode, he must purchase a multimode electrostatic copying apparatus. In such a case, the previously purchased single mode electrostatic apparatus becomes a waste.

In view of this fact, U.S. patent application Ser. No. 650,605 now U.S. Pat. No. 4,607,942 whose assignee is the same as the assignee of the present application, or the corresponding European Patent Application No. 84111120.6 proposed an auxiliary unit which can be detachably mounted as desired on a relatively inexpensive electrostatic copying apparatus capable of performing only the ordinary copying mode, and which selectively performs the ordinary copying mode or the both surface copying mode. The previously proposed auxiliary unit, however, has not proved to be entirely satisfactory and entails problems that have to be solved. Among these problems are:

(a) It is relatively complex and expensive.

(b) It is relatively bulky.

(c) It can peform the both surface copying mode selectively in addition to the ordinary copying mode, but cannot perform the overlapping copying mode.

(d) There is a great likelihood that a trouble will occur in conveying a copying paper within the auxiliary unit to cause paper jamming.

(e) In the event of papeCr jamming, the operation of removing the paper is comparatively difficult.

(f) The widthwise position of a copying paper in the auxiliary unit can be regulated only insufficiently, and a copied image cannot be formed in a required manner on the other surface of a copying paper in the both surface copying mode.

SUMMARY OF THE INVENTION

It is a primary object of this invention to provide an improved relatively simple and inexpensive auxiliary unit which can be detachably mounted as desired on a relatively inexpensive electrostatic copying apparatus capable of performing only the ordinary copying mode and can selectively perform not only the ordinary copying mode but also the both surface copying mode and/or the overlapping copying mode.

Another object of this invention is to provide a novel and excellent combination of an electrostatic copying apparatus and the aforesaid auxiliary unit which can selectively perform the ordinary copying mode and the both surface copying mode and/or the overlapping copying mode without an error by an easy and simple operation in spite of the fact that a control of the electrostatic copying apparatus and a control of the auxiliary unit are separately established without exchange of control signals between the copying apparatus and the auxiliary unit for simplification of the method of control.

Other objects of this invention will become apparent from the following description.

According to this invention, there is provided an auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and being adapted to form a copied image on one surface of the copying paper while the paper introduced into the paper conveying passage from the paper feed means or the paper feed passage is conveyed through the paper conveying passage; said auxiliary unit comprising an inlet portion adapted to be connected to the downstream end of the paper conveying passage, an outlet portion adapted to be connected to the downstream end of the paper feed passage, a copying paper stock means located adjacent to the outlet portion, and a copying paper moving passage disposed between the inlet portion and the paper stock means, and further including various improvements achieved.

The various improvements on the auxiliary unit will become apparent from the following description.

The present invention also provides a combination of the electrostatic copying apparatus and the auxiliary unit, wherein a unique improved operation control means is provided in the electrostatic copying apparatus.

BRIEF DESCRIPTION OF THE DRAWINGS

FIGS. 12-A, 12-B and 12-C are flow charts showing the operating procedure of the auxiliary unit shown in FIG. 2;

FIGS. 14-A, 14-B and 14-C are flow charts showing the control sequence of the electrostatic copying apparatus shown in FIG. 1.

DETAILED DESCRIPTION OF THE INVENTION

With reference to the accompanying drawings, preferred embodiments of the electrostatic copying apparatus and the auxiliary unit in accordance with this invention will be described in detail.

Outline of the Electrostatic Copying Apparatus

Figure 1:
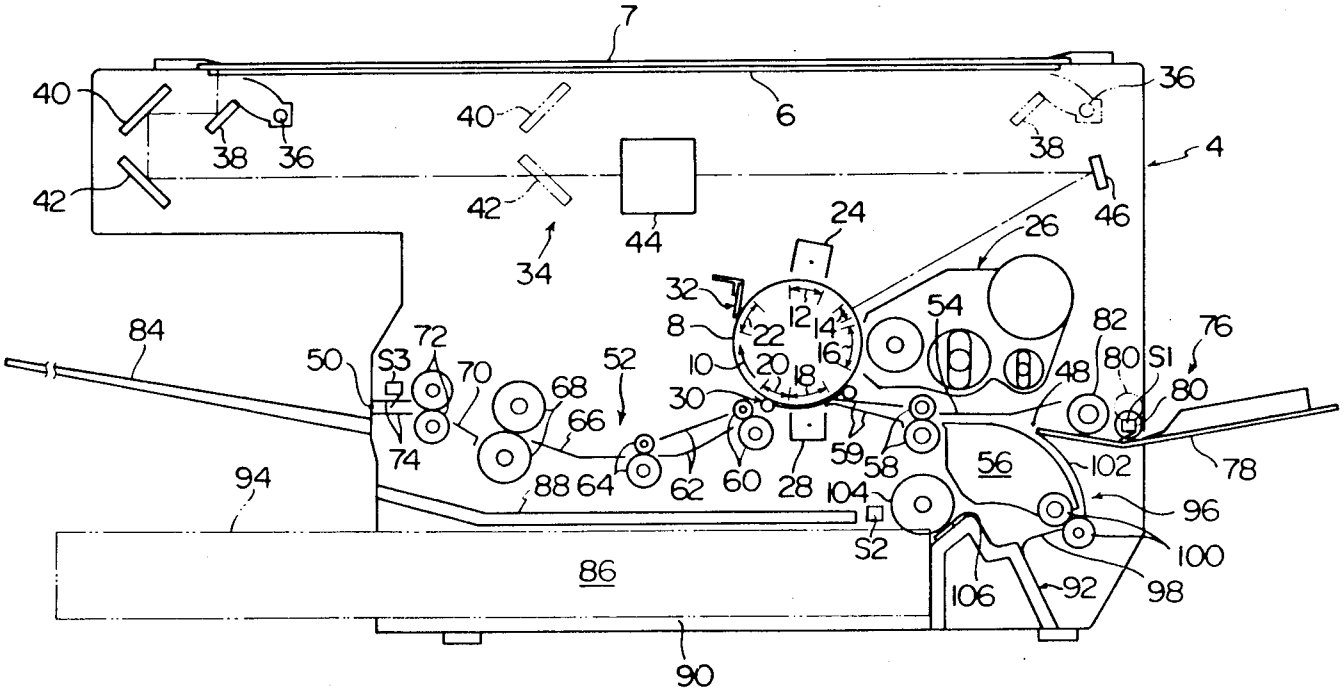
FIG. 1 is a simplified sectional view showing one embodiment of an electrostatic copying apparatus on which the auxiliary unit constructed in accordance with this invention may be detachably mounted.

FIG. 1 shows a preferred embodiment of the electrostatic copying apparatus in a simplified form. The illustrated electrostatic copying apparatus shown generally at 2 has a housing 4. A stationary transparent plate 6 on which to place a document (not shown) to be copied is disposed on the upper surface of the housing 4. An openable and closable document holding member 7 for covering the transparent plate 6 and the document placed on it is further disposed on the upper surface of the housing 4. A rotating drum 8 having an electrostatic photosensitive material disposed on its surface is provided nearly centrally within the housing 4. The rotating drum 8 is rotated in the direction shown by an arrow 10. Around the rotating drum 8 are defined a charging zone 12, an exposing zone 14, a developing zone 16, a transferring zone 18, a peeling zone 20 and a cleaning zone 22 in this order as viewed in the rotating direction of the drum 8. A charging corona discharger 24 is disposed in the charging zone 12. A developing device 26 is disposed in the developing zone 16. A transfer corona discharger 28 is provided in the transferring zone 18. A peeling mechanism 30 is provided in the peeling zone 20. A cleaning blade mechanism 32 is disposed in the cleaning zone 22.

An optical system shown generally at 34 is disposed above the rotating drum 8. The optical system 34 comprises a movable document illuminating lamp 36, a first, a second and a third movable reflecting mirror 38, 40 and 42, a lens 44 and a reflecting mirror 46. The document illuminating lamp 36 and the first, second and third reflecting mirrors 38, 40 and 42 are caused to reciprocate between a position shown by the solid line and a position shown by the two-dot chain line. In scanning exposure, the document illuminating lamp 36 and the first reflecting mirror 38 are moved at a predetermined speed to the right from the positions shown by the solid line, and the second and third reflecting mirrors 40 and 42 are moved at a speed half of the above predetermined speed to the right from the positions shown by the solid line. As a result, a document placed on the transparent plate 6 is scanned, and an image corresponding to the document is exposed to the surface of the rotating drum in the exposing zone 14 via the first, second, and third reflecting mirrors 38, 40 and 42, the lens 44 and the reflecting mirror 46.

Beneath the rotating drum 8 is disposed a copying paper conveying passage 52 which extends from a position 48 near the right end of the housing 4 to a position 50 at the left end of the housing 4 via the transferring zone 18. The copying paper conveying passage 52 is defined by a guide plate 54 and the upper surface of a member 56 cooperating with the guide plate 54, a pair of introduction rollers 58, a pair of guide plates 59, a pair of conveyor rollers 60, a pair of guide plates 62, a pair of conveyor rollers 64, a pair of guide plates 66, a pair of fixing rollers 68 constituting a heat-pressing type fixing device, a pair of guide plate 70, a pair of discharge rollers 72 and a pair of guide plates 74 in this sequence from right to left. A copying paper feeding means shown generally at 76 for feeding copying paper sheets one by one to the paper conveying passage 52 is disposed in the right end portion of the housing 4. The paper feed means 76 includes a paper placing table 78, a driven delivery roller 80 mounted for free movement between a lowered position shown by the solid line and an elevated position shown by the two-dot chain line, and a driven conveyor roller 82 disposed downstream of the delivery roller 80. In the paper feed means 76, a layer of stacked copying paper sheets in number less than a certain predetermined number (for example, 50) is placed manually on the table 78 with the front end portion of the paper layer positioned below the delivery roller 80 while the delivery roller 80 is held at the elevated position shown by the two-dot chain line. In feeding the paper sheets to the paper conveying passage 52, the delivery roller 80 is lowered and brought into contact with the uppermost paper sheet of the paper layer. By the rotation of the delivery roller 80, the uppermost paper is delivered forwardly and then conveyed forwardly by the action of the conveyor roller 82. On the left end of the housing 4 is detachably mounted a receiving tray 84 for collecting copying paper sheets discharged from the downstream end 50 fo the paper conveying passage 52.

Furthermore, in the illustrated electrostatic copying apparatus 2, a relatively large nearly parallelpipedal space 86 with an open left end is formed in the lower portion of the housing 4. The upper surface of the space 86 is defined by a plate member 88 and its lower surface, by a base plate 90 extending substantially horizontally. The front surface of the space 86 is defined by the left end surface of a member 92. A copying paper cassette 94 holding a layer of a plurality of copying paper sheets in the stacked state is detachably loaded in the space 86 as shown by a two-dot chain line. In relation to the space 86, a copying paper feed passage 96 which extends in curve from the front end of the space 86 to the upstream end portion of the paper conveying passage 52 is disposed within the housing 4. The paper feed passage 96 is defined by the lower surface of the member 56, the upper surface of the member 92 cooperating with the member 56, a guide plate 98, a pair of conveyor rollers 100, the right end surface of the member 56 and a guide plate 102 cooperating with it in this sequence from its upstream end to its downstream end. The downstream end of the paper feed passage 96 is connected sufficiently smoothly to the upstream end portion of the paper conveying passage 52. At the upstream end of the paper feed passage 96 is disposed a driven delivery roller 104 for delivering the copying paper sheets one by one from the paper cassette 94. An overlapping-feed preventing member 106 formed of a material having a high coefficient of friction is fixed to the member 92. The overlapping-feed preventing member 106 surely prevents feeding of two or more copying paper sheets at a time from the paper cassette 94 to the paper feed passage 96.

The operation of the electrostatic copying apparatus 2 described above is summarized as follows: The rotating drum 8 is rotated in the direction of arrow 10. In the charging zone 12, the surface of the rotating drum 8 is charged to a specified polarity by the action of the charging corona discharger 24. Then, in the exposing zone 14, the document placed on the transparent plate 6 is scanned by the optical system 34 and an image corresponding to the document is optically projected onto the surface of the rotating drum 8. As a result, a latent electrostatic image corresponding to the image of the document is formed on the surface of the rotating drum 8. In the developing zone 16, a toner is applied to the latent electrostatic image by the developing device 26 to develop it to a toner image. In the meantime, a copying paper is fed to the paper conveying passage 52 from the paper feed means 76 or from the paper cassette 94 via the paper feed passage 96. The fed paper passes through the transferring zone 18 in synchronism with the rotation of the rotating drum 8. In the transferring zone 18, one surface (upper surface) of the paper is brought into intimate contact with the surface of the rotating drum 8, and the toner image is transferred from the surface of the drum 8 to the contacting surface of the paper by the action of the transfer corona discharger 28. Then, in the peeling zone 20, the copying paper is peeled from the surface of the rotating drum 8 by the action of the peeling mechanism 30. In the cleaning zone 22, the toner remaining on the surface of the rotating drum 8 after image transfer is removed by the action of the cleaning blade mechanism 32. In the meanwhile, the peeled paper is conveyed further through the paper conveying passage 52, and the toner image on its one surface is fixed by the action of the pair of fixing rollers 68. Thereafter, the copying paper is discharged onto the receiving tray 84. As a result, a copy having a copied image on one surface is obtained.

The structure and operation described above of the illustrated copying apparatus 2 do not constitute any novel feature of the invention. Hence, any detailed description thereof will be omitted in the present specification.

Auxiliary Unit

According to a preferred embodiment of this invention, there is provided an auxiliary unit which is detachably mounted on the electrostatic copying apparatus 2 in place of the paper cassette 94 and which makes it possible to selectively perform the ordinary copying mode described above, and the both surface copying mode and the overlapping copying mode. The auxiliary unit will now be described in detail.

Outline of the General Structure of the Auxiliary Unit

Figure 2:
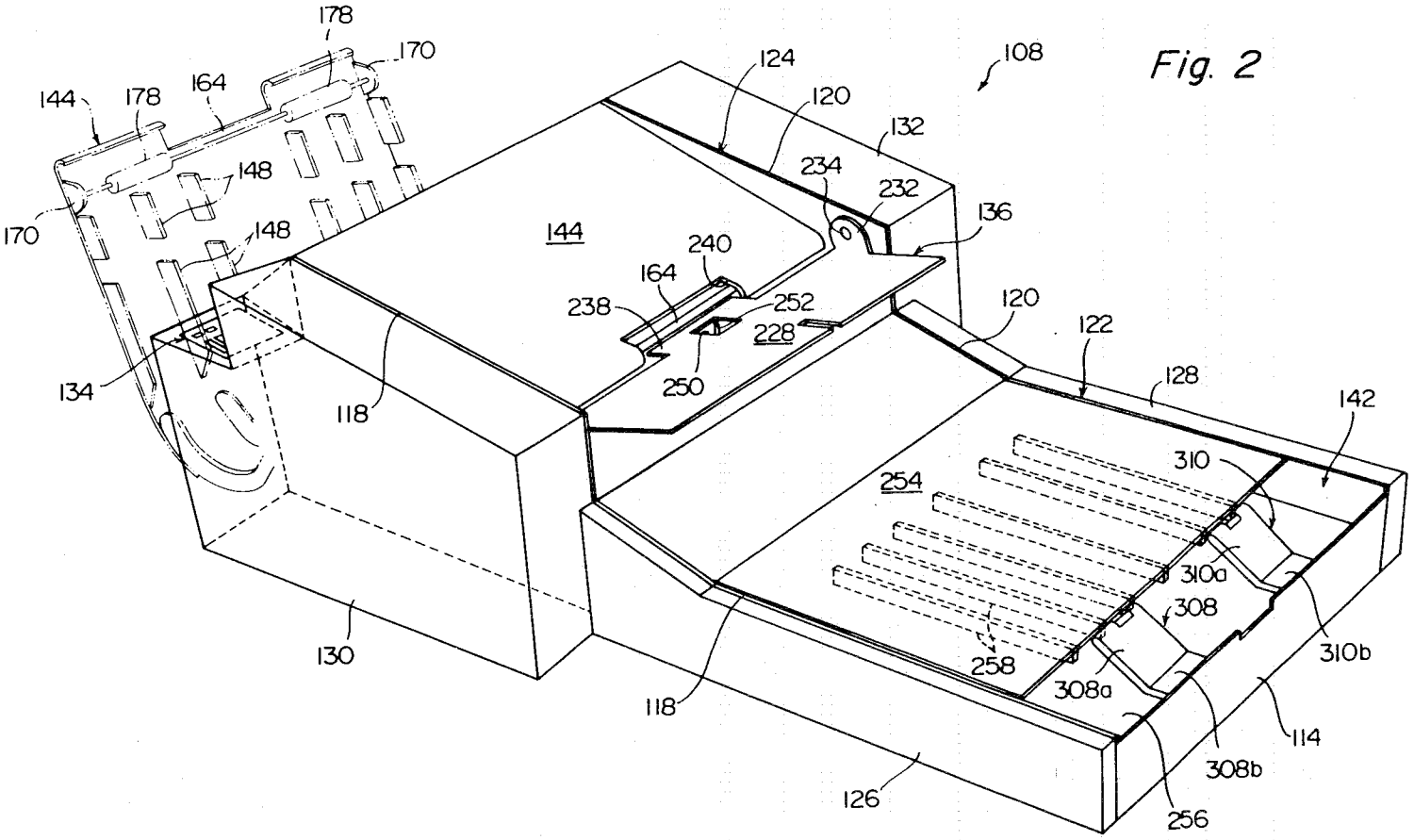
FIG. 2 is a perspective view showing a preferred embodiment of the auxiliary unit of the invention.
Figure 3:
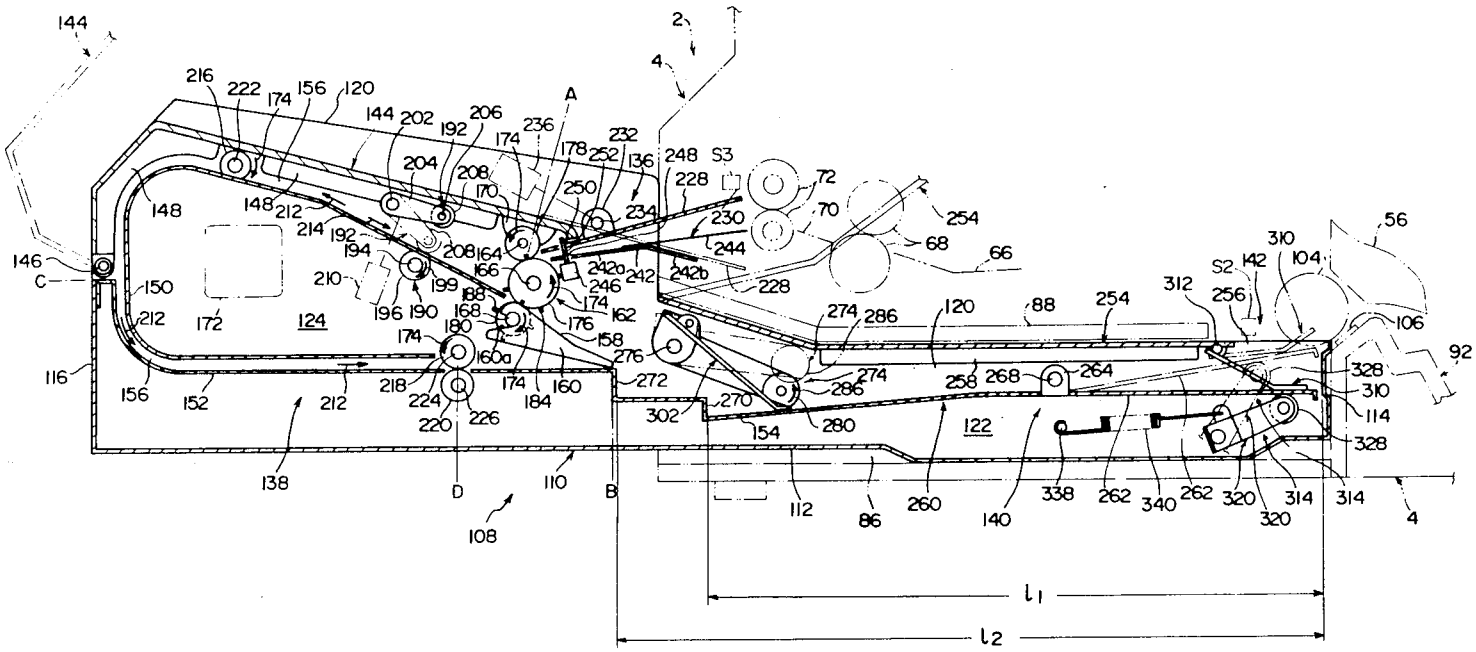
FIG. 3 is a simplified sectional view of the auxiliary unit shown in FIG. 2.

With reference to FIGS. 2 and 3, the illustrated auxiliary unit, shown generally at 108, has a supporting base plate 110. The supporting base plate 110 includes a bottom wall portion 112 extending in the left-right direction in FIG. 3, a front wall portion 114 extending upwardly from the front end (the right end in FIG. 3) of the bottom wall portion 112, and a rear wall portion 116 extending upwardly from the rear end (the left end in FIG. 3) of the bottom wall portion 112. A front vertical base plate 118 and a rear vertical base plate 120 are fixed respectively to the front edge and the rear edge of the supporting base plate 110. The front half portions of the front vertical base plate 118 and the rear vertical base plate 120 are relatively low and in cooperation with the front wall portion 114, define a relatively low front box-like housing portion 122 having an open upper surface and an open rear surface. On the other hand, the rear half portions of the front vertical base plate 118 and the rear vertical base plate 120 are relatively high, and in cooperation with the rear wall portion 116, define a relatively high rear box-like housing portion 124 having an open upper surface and an open front surface. As clearly shown in FIG. 2, a cover 126 is applied to the outside of the relatively low front half portion of the front vertical base plate 118, and likewise, a cover 128 is applied to the outside of the relatively low front half portion of the rear vertical base plate 120. The widthwise size between the outside surface of the cover 126 and the outside of the cover 128 corresponds to the widthwise size of the space 86 formed in the housing 4 of the electrostatic copying apparatus 2, and the height of the front box-like housing portion 122 corresponds to the height of the space 86 (see FIG. 1 also). A cover 130 is applied to the outside of the relatively high rear half portion of the front vertical base plate 118, and likewise, a cover 132 is applied to the outside of the relatively high rear half portion of the rear vertical base plate 120. A stepped portion is formed in the rear end portion of the cover 130, and an operating panel 134 is disposed in the stepped portion. The operating panel has various switches and display lamps mounted thereon as will be described hereinafter.

An inlet portion shown generally at 136 and a copying paper moving passage shown generally at 138 are provided in the rear box-like housing portion 124, and a copying paper stock means shown generally at 140 and an outlet portion 142 are provided in the front box-like housing portion 122.

Copying Paper Moving Passage

With reference to FIGS. 2 and 3, a nearly L-shaped cover plate 144 is mounted on the upper portion of the rear box-like housing portion 124. The rear end portion of the cover plate 144 is pivotably mounted on a shaft 146 fixed to the rear end of the front vertical base plate 118 and the rear vertical base plate 120 so that the cover 144 can be pivoted between a closed position shown by a solid line and an open position shown by a two-dot chain line. When the cover plate 144 is held at the closed position shown by the solid line, the upper surface of the rear box-like housing portion 124 is covered with the cover plate 144 excepting a portion where the inlet portion 136 is disposed. As will be clear from the following description, the upper surface of the cover plate 144 constitutes a receiving surface for gathering copying paper sheets. A plurality of upper defining plates 148 are provided on the inner surface of the cover plate 144 at suitable intervals in the widthwise and longitudinal directions (as will be described hereinafter, the upper defining plates 148 define the upper side of a part of the copying paper moving passage). A nearly C-shaped guide plate 150 is fixedly provided below the cover plate 144 and between the front vertical base plate 118 and the rear vertical base plate 120. Between the front vertical base plate 118 and the rear vertical base plate 120 are further fixedly provided a nearly L-shaped guide plate 152 located below the guide plate 150 and a plate member 154 extending forwardly from a position adjoining the front end of the guide plate 152. Thus, within the rear boxlike housing portion 124, a nearly C-shaped curved reversal passage 156 extending from its upstream end shown by symbol A to its downstream end shown by symbol B is defined. In more detail, that part of the curved reversal passage 156 which ranges from the upstream end A to a position shown by symbol C is defined between the guide plate 150 and the plurality of upper defining plates 148 formed on the inner surface of the cover plate 144. That part ranging from the position C to a position shown by symbol D is defined between the guide plate 150 and the guide plate 152. That part which ranges from the position D to the downstream end B extends along the upper surface of the rear end portion of the plate member 154. The copying paper moving passage shown generally at 138 includes a short-circuit passage 158 which short-circuits between the upstream end portion of the curved reversal passage 156 and its downstream end B. As clearly shown in FIG. 3, the short-circuit passage 158 is positioned above the downstream end portion of the curved reversal passage 156. Two nearly triangular guide members 160 are spaced in the widthwise direction between the downstream end portion of the curved reversal passage 156 and the short-circuit passage 158 (such guide members 160 will be more specifically described hereinbelow). In other words, the downstream end portion of the curved reversal passage 156 is defined between the rear end portion of the plate member 154 and the guide member 160. The short-circuit passage 158 extends along the upper surface of the guide member 160.

Figure 4:
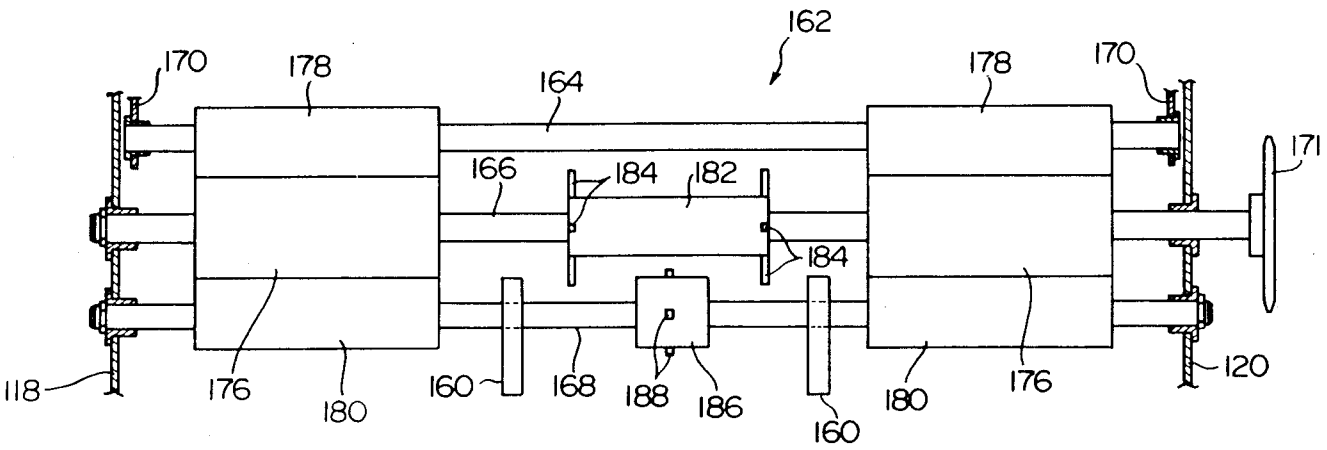
FIG. 4 is a partial sectional view showing a multifunctional conveying means in the auxiliary unit shown in FIG. 2.

A multifunctional conveying means shown generally at 162 is disposed at the upstream end A of the curved reversal passage 156 and the upstream end of the short-circuit passage 158. With reference to FIG. 4 as well as FIG. 3, the multifunctional conveying means 162 includes an upper supporting shaft 164, an intermediate supporting shaft 166 and a lower supporting shaft 168 disposed at vertically spaced positions. The both end portions of each of the intermediate supporting shaft 166 and the lower supporting shaft 168 are rotatably mounted on the front vertical base plate 118 and the rear vertical base plate 120. The both end portions of the upper supporting shaft 164 are mounted rotatably on downwardly extending pieces 170 formed on the two side edges of the inner surface of the free end portion (front end portion) of the cover plate 144. As clearly shown in FIG. 4, the rear end portion of the intermediate supporting shaft 166 projects rearwardly beyond the rear vertical base plate 120, and to its projecting end is fixed an input element 171 which may be a sprocket wheel. The input element 171 is drivingly connected via a suitable drive linking means (not shown) to the output shaft of a rotary driving source 172 (FIG. 3), which may be an electric motor, disposed within a space surrounded by the guide plate 150. When the driving source 172 is energized, the intermediate supporting shaft 166 is rotated in the direction shown by an arrow 174 in FIG. 3. Two axially spaced intermediate conveyor rollers 176 are fixed to the intermediate supporting shaft 166. Opposite to the intermediate conveyor rollers 176, two upper conveyor rollers 178 and two lower conveyor rollers 180 are respectively fixed to the upper supporting shaft 164 and the lower supporting shaft 168. When the cover plate 144 is held at the closed position shown by the solid line in FIGS. 2 and 3, the upper conveyor rollers 178 are pressed against the intermediate conveyor rollers 176 by the weight of the cover plate 144. When the driving source 172 is energized and the intermediate supporting shaft 166 and the intermediate conveyor rollers 176 fixed to it are rotated in the direction of arrow 174, the upper conveyor rollers 178, the upper supporting shaft 164 to which the rollers 178 are fixed, the lower conveyor rollers 180, and the lower supporting shaft 168 to which the rollers 180 are fixed are accordingly rotated in the direction of arrow 174. The upper conveyor rollers 178 and the intermediate conveyor rollers 176 cooperatively define the upstream end of the curved reversal passage 156, and function as an introduction roller pair which introduces a copying paper sheet from the inlet portion 136 into the curved reversal passage 156 from its upstream end. On the other hand, the lower conveyor rollers 180 and the intermediate conveyor rollers 176 cooperate with each other to define the upstream end of the short-circuit passage 158, and function as an introduction roller pair which introduces a copying paper sheet from the curved reversal passage 156 into the short-circuit passage 158 from its upstream end.

In the illustrated embodiment, a roller 182 is fixed to the central part in the widthwise direction of the intermediate supporting shaft 166. Circumferentially spaced intermediate protrusions 184 extending radially are formed respectively at the both end portions of the roller 182. Preferably, the intermediate protrusions 184 are made of a flexible material such as synthetic rubber. As can be easily understood by reference to FIGS. 3 and 4, the outside diamter of the roller 182 is smaller than the outside diameter of the intermediate conveyor rollers 176, but the intermediate protrusions 184 project radially beyond the peripheral surfaces of the intermediate conveyor rollers 176. Furthermore, a roller 186 is fixed to the central part in the widthwise direction of the lower supporting shaft 168, and circumferentially spaced, radially extending lower protrusions 188 are formed in the center in the widthwise direction of the roller 186. Preferably, the lower protrusions 188 are formed of a flexible material such as synthetic rubber as are the intermediate protrusions 184. It will be easily understood by referring to FIGS. 3 and 4 that the outside diameter of the roller 186 is substantially equal to, or smaller than, the outside diameter of the lower conveyor rollers 180, but the lower protrusions 188 protrude radially beyond the peripheral surfaces of the lower conveyor rollers 180. As shown in FIG. 4, the intermediate protrusions 184 and the lower protrusions 188 are preferably positioned deviatingly without being aligned in the widthwise direction. The operation and effect of the intermediate protrusions 184 and the lower protrusions 188 will be described hereinafter.

Again, with reference to FIGS. 3 and 4, one end portion of each of the two guide members 160 is mounted on the lower supporting shaft 168 at each of two sites between the roller 186 and each of the two lower conveyor rollers 180. As shown in FIG. 3, a rearwardly opened cut **160*a* is formed at the rear end portion of each of the guide members 160. By permitting the supporting shaft 168 to be received by the cuts 160*a*, the guide members 160 are mounted detachably and pivotably on the supporting shaft 168. Each of the guide member 160 extends from its one end portion described above in the paper moving direction, namely toward the right in FIG. 3, and is biased clockwise in FIG. 3 by its own weight whereby its free end abuts against the upper surface of the rear end portion of the plate member 154. If desired, the guide members 160 may be elastically biased clockwise in FIG. 3** by using a suitable spring.

Figure 5:
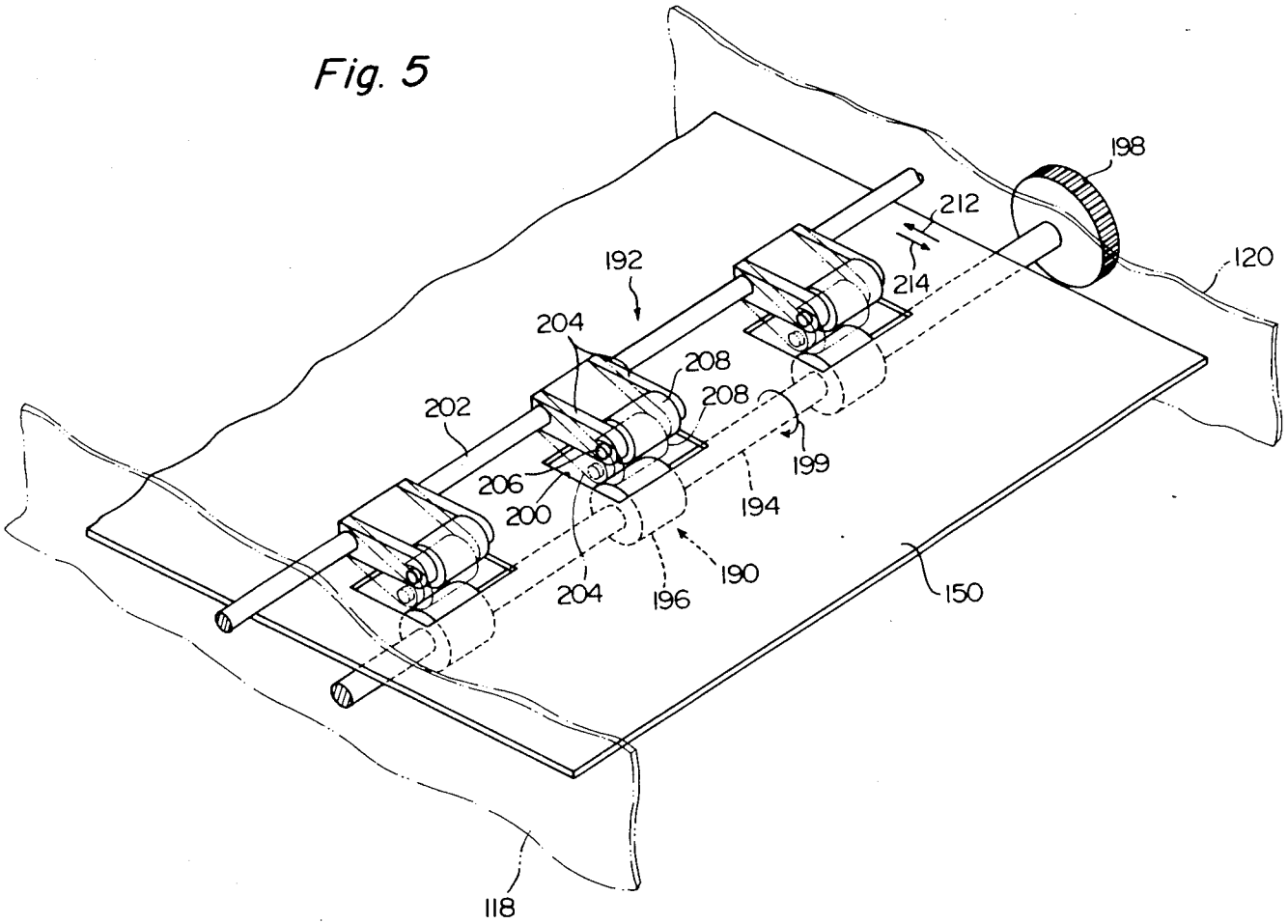
FIG. 5 is a partial perspective view showing a reverse direction moving means and a pressing means in the auxiliary unit shown in FIG. 2.

A reverse direction moving means 190 and a pressing means 192 selectively cooperating with it are disposed in the curved reversal passage 156 at a site downstream of the upstream end A by a predetermined distance. With reference to FIG. 5 in conjunction with FIG. 3, the reverse direction moving means 190 includes a supporting shaft 194 and three rollers 196 fixed to the supporting shaft 194 in widthwise spaced relationship. The opposite end portions of the supporting shaft 194 are rotatably mounted on the front vertical base plate 118 and the rear vertical base plate 120. The rear end portion of the supporting shaft 194 is projected rearwardly beyond the rear vertical base plate 120, and an input element 198 which may be a gear is fixed to its projecting end. The input element 198 is drivingly connected to the output shaft of the rotating drive source 172 via a suitable drivingly connecting means (not shown). When the rotating drive source 172 is energized, the supporting shaft 194 and the rollers 196 fixed to it are rotated in the direction shown by an arrow 199. As clearly shown in FIG. 5, openings 200 are formed in the guide plate 150 corresponding respectively to the three rollers 196, and the rollers 196 are exposed upwardly through these openings 200. On the other hand, the pressing means 192 includes a supporting shaft 202 disposed at a predetermined position above the guide plate 150, and the opposite end portions of the supporting shaft 202 are rotatably mounted on the front vertical base plate 118 and the rear vertical base plate 120. Three supporting arm pairs 204 are fixed to the supporting shaft 202 in widthwise spaced relationship, and a roller 208 is mounted on each free end of the supporting arm pairs 204 by means of a shaft 206. The rear end portion of the supporting shaft 202 is projected rearwardly beyond the rear vertical base plate 120, and the output terminal of an actuating means 210 (FIG. 3) which may be an electromagnetic solenoid mounted on the outside surface of the rear vertical base plate 120 is connected to the projecting end of the rear end portion of the supporting shaft 202. When the actuating means 210 (FIG. 3) is in the deenergized state, the roller 208 is held at a non-operating position shown by a solid line in FIGS. 3 and 5, and at this non-operating position, the roller 208 is biased a predetermined distance upwardly from the roller 196. When the actuating means 210 is energized, the supporting shaft 202 is rotated clockwise in FIG. 3, and the roller 208 is held at an operating position shown by a two-dot chain line in FIGS. 3 and 5 and thus pressed against the rollers 196. As will be stated hereinabove, when the roller 208 is held at the non-operating position, the copying paper is moved between the rollers 196 and the roller 208 in the direction shown by an arrow 212 in spite of the rollers 196 being rotated in the direction shown by an arrow 199. On the other hand, when the roller 208 is held at the operating position, the copying paper present between the rollers 196 and the roller 208 is pressed against the rollers 196 by the roller 208. As a result, the roller 208 is rotated incident to the rotation of the rollers 196 in the direction of arrow 199, and the copying paper is moved in a reverse direction, namely in the direction shown by an arrow 214. As shown in FIG. 3, a roller 216 and cooperating rollers 218 and 220 are further disposed in the curved reversal passage 156 in order to move the copying paper in the direction of arrow 212. The roller 216 is fixed to a supporting shaft 222, and its peripheral surface is kept in contact with the upper surface of the guide plate 150. The supporting shaft 222 is rotatably mounted at tis both end portions on the front vertical base plate 118 and the rear vertical base plate 120, and drivingly connected to the rotating drive source 172 via a suitable drivingly connecting means (not shown). When the drive source 172 is energized, the supporting shaft 222 and the roller 216 fixed to it are rotated in the direction shown by an arrow 174. The rollers 218 and 220 are fixed at both end portions to supporting shafts 224 and 226 respectively which are rotatably mounted on the front vertical base plate 118 and the rear vertical base plate 120. The supporting shaft 224 is drivingly connected to the rotary driving source 172 via a suitable drivingly connecting means (not shown). When the rotary driving source 172 is energized, the supporting shaft 224 and the roller 218 fixed to it are rotated in the direction of arrow 174, and incident to it, the roller 220 and the supporting shaft 226 to which the roller 220 is fixed are rotated in the direction of arrow 174.

Inlet Portion

With reference to FIGS. 2 and 3, the inlet portion 136 will be described in detail. An upper movable guide plate 228 and a lower guide plate 230 below it are disposed in the inlet portion 136 positioned at the upper front end portion of the rear box-like housing portion 124. The upper movable guide plate 228 constituting an introduction controlling member is selectively held at an introduction position shown by a solid line in FIG. 3 and a non-introduction position shown by a two-dot chain line in FIG. 3. In more detail, an upwardly extending projecting piece 232 is formed at both side edges of the upper movable guide plate 228, and a pin 234 is fixed to the projecting piece 232. The pins 234 are rotatably mounted on the front vertical base plate 118 and the rear vertical base plate 120, respectively. One of the two pins 234 projects rearwardly beyond the rear vertical base plate 118, and the output terminal of an actuating means 236 which may be an electromagnetic solenoid mounted on the outside surface of the rear vertical base plate 118 is connected to the projecting end of the pin 234. When the actuating means 236 is in the energized state, the upper movable guide plate 228 is held at the introduction position shown by the solid line in FIG. 3. When it is deenergized, the upper movable guide plate 228 is pivoted clockwise in FIG. 3 and held at the non-introduction position shown by the two dot chain line in FIG. 3. As shown in FIG. 2, a projecting portion 238 is formed in the center of the downstream end (the left end in FIG. 3) of the upper movable guide member 228, and opposite to it, a cut 240 is formed in the upstream end (the right end in FIG. 3) of the cover plate 144. When the upper movable guide plate 228 is held at the introduction position, the projecting portion 238 is located below the cut 240. When the upper movable guide plate 228 is held at the non-introduction position, the projecting portion 238 is positioned in the cut 240, and the upper surface of the projecting portion 238 is positioned on substantially the same level as, or slightly upwardly of, the upper surface of the cover plate 144 constituting a receiving surface. The lower guide plate 230 is constructed of a rigid member 242 and a flexible member 244. The rigid member 242 is fixed between the front vertical base plate 118 and the rear vertical base plate 120. The rigid member 242 has a downstream portion **242*a* extending while being slightly inclined downwardly and to the left in FIG. 3 and an upstream portion 242*b* extending while being slightly inclined downwardly and to the right. The flexible member 244 extends from its one end fixed to the downstream portion 242*a* of the rigid member 242 to the right in FIG. 3. When the upper movable guide plate 228 is held at the introduction position, the flexible member 244 extends in a straight line together with the downstream portion 242*a* of the rigid member 242 as shown by the solid line in FIG. 3. But when the upper movable guide member 228 is held at the non-introduction position, the flexible member 244 is bent downwardly by the upper movable guide plate 228, and the flexible member 244 extends along the upstream portion 242*b* of the rigid member 242, as shown by the two-dot chain line in FIG. 3. As will be described hereinafter in more detail, when the upper guide plate 228 constituting an introduction controlling member is held at the introduction position, the copying paper discharged from the electrostatic copying apparatus 2 (FIG. 1) passes between the upper movable guide plate 228 and the lower guide plate 230 and is introduced into the paper moving passage 138, more specifically into the curved reversal passage 156. On the other hand, when the upper guide plate 228 is held at the non-introduction position, the copying paper discharged from the electrostatic copying apparatus 2 (FIG. 1) is moved along the upper surface of the upper movable guide plate 228, and conducted to the upper surface of the cover plate 144** constituting a receiving surface.

At the inlet position 136, there is further provided a detecting means 246 for detecting the copying paper which moves between the upper movable guide plate 228 and the lower guide plate 230 when the upper movable guide plate 228 is held at the introduction position. The detecting means 246 may be a normarlly open microswitch having a detecting arm 252 which extends through an opening 240 formed in the lower guide plate 230 and an opening 250 formed in the upper movable guide plate 228.

Paper Stock Means and the Outlet Portion

With reference to FIGS. 2 and 3, a nearly flat plate-like cover plate 254 is mounted on the upper end portion of the front box-like housing portion 122. The rear end portion of the cover plate 254 is mounted pivotably on the front vertical base plate 118 and the rear vertical base plate 120 via a suitable shaft (not shown), and the cover plate 254 can be pivoted and opened counterclockwise as shown by a two-dot chain line from its closed position shown by a solid line. When the cover plate 254 is held at the closed position, the front end of the cover plate 254 is positioned rearwardly of the front end of the front box-like housing portion 122 by a predetermined distance. Hence, a greater portion of the upper surface of the box-like housing portion 122 is covered with the cover plate 254, but its front end portion is not covered with the cover plate 254 and an opening 256 remains as it is. As will be made clear hereinafter, the opening 256 constitutes the aforesaid outlet portion 142 for discharging the copying paper stocked in the paper stock means 140. Conveniently, a plurality of guide plates 258 are formed in widthwise spaced relationship on the inside surface of the cover plate 254.

Figure 6:
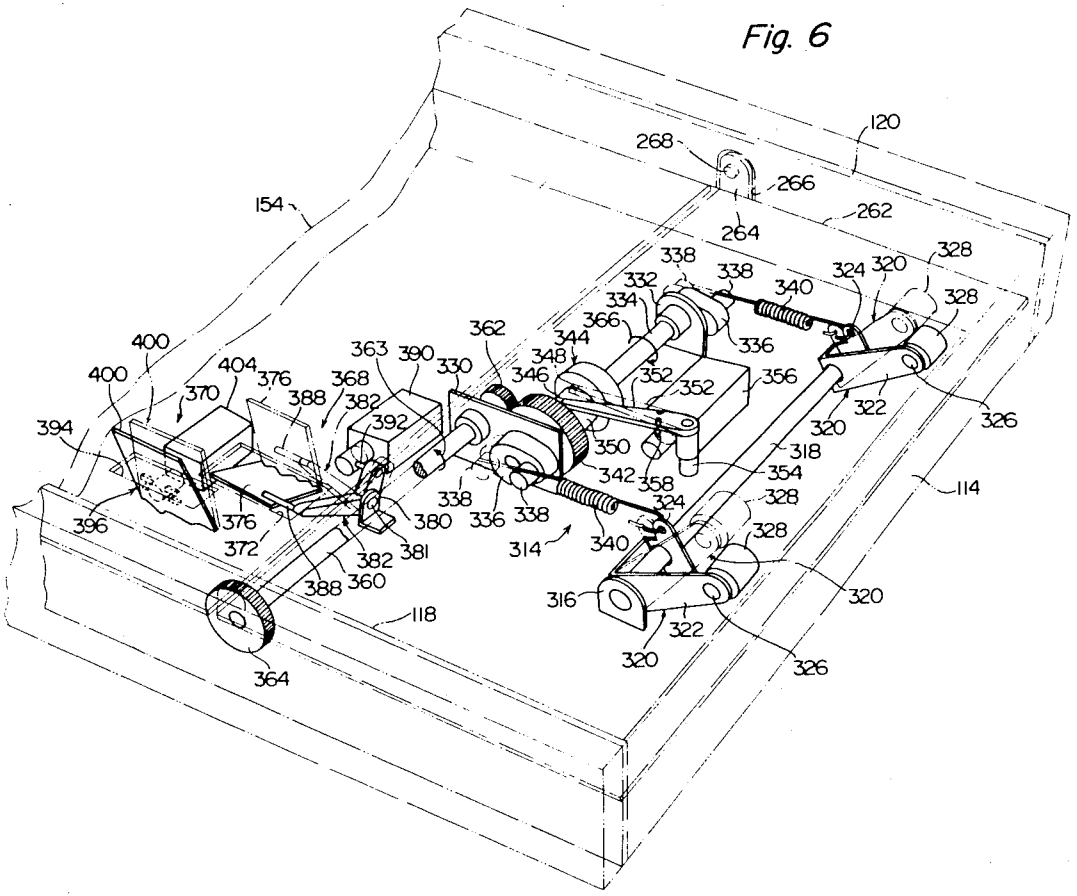
FIG. 6 is a partial perspective view showing an elastic biasing means and a first and a second widthwise moving mechanism in the auxiliary unit shown in FIG. 2.

Further, with reference to FIG. 3, the paper stock means 140 is disposed within the front box-like housing portion 122. The paper stock means 140 includes a paper supporting plate 260 extending in the paper moving direction, namely in the left-right direction in FIG. 3. The illustrated paper supporting plate 260 is constructed of the front portion of the plate member 154 fixed between the front vertical base plate 118 and the rear vertical base plate 120 (that portion of the plate member 154 which extends to the right in FIG. 3 from the downstream end B of the curved reversal passage 156) and a movable supporting plate piece 262 extending from a position adjacent to the front end of the plate member 154 to a position adjacent to the front wall portion 114 of the supporting base plate 110. With reference to FIG. 6 in conjunction with FIG. 3, a projecting piece 264 slightly projecting outwardly in the widthwise direction and then extending upwardly is formed at each of the side edges of the rear end portion of the movable supporting plate 262. On the other hand, a depression 266 opposite to the projecting piece 264 is formed in the inside surface of each of the front vertical base plate 118 and the rear vertical base plate 120. The projecting piece 264 is positioned within the depression 266, and mounted pivotably by a pin 268 on each of the front vertical base plate 118 and the rear vertical base plate 120. As a result, the movable supporting plate piece 262 can be selectively pivoted counterclockwise as shown by a two-dot chain line in FIG. 3 from a receiving position shown by a solid line in FIG. 3 and elevated. Means for selectively elevating the movable supporting plate piece 262 will be described in detail hereinafter.

Two stepped portions 270 and 272 spaced from each other longitudinally by a predetermined distance are formed in the plate member 154. In the illustrated embodiment, copying paper sheets of two different sizes designated by JIS B5 and JIS A4 are used. The length from the stepped portion 270 to the front wall portion 114, $l_1$, corresponds to the longitudinal length of the JIS B5 paper, and the length from the stepped portion 272 to the front wall portion 114, $l_2$, corresponds to the length of the JIS A4 paper. The front wall portion 114 projects upwardly beyond the upper surface of the movable supporting plate piece 262 held at the receiving position, and as will be made clear hereinafter, constitutes paper leading edge restricting plate against which the leading edge of the paper advancing along the upper surface of the paper supporting plate 260 abuts.

Figure 7:
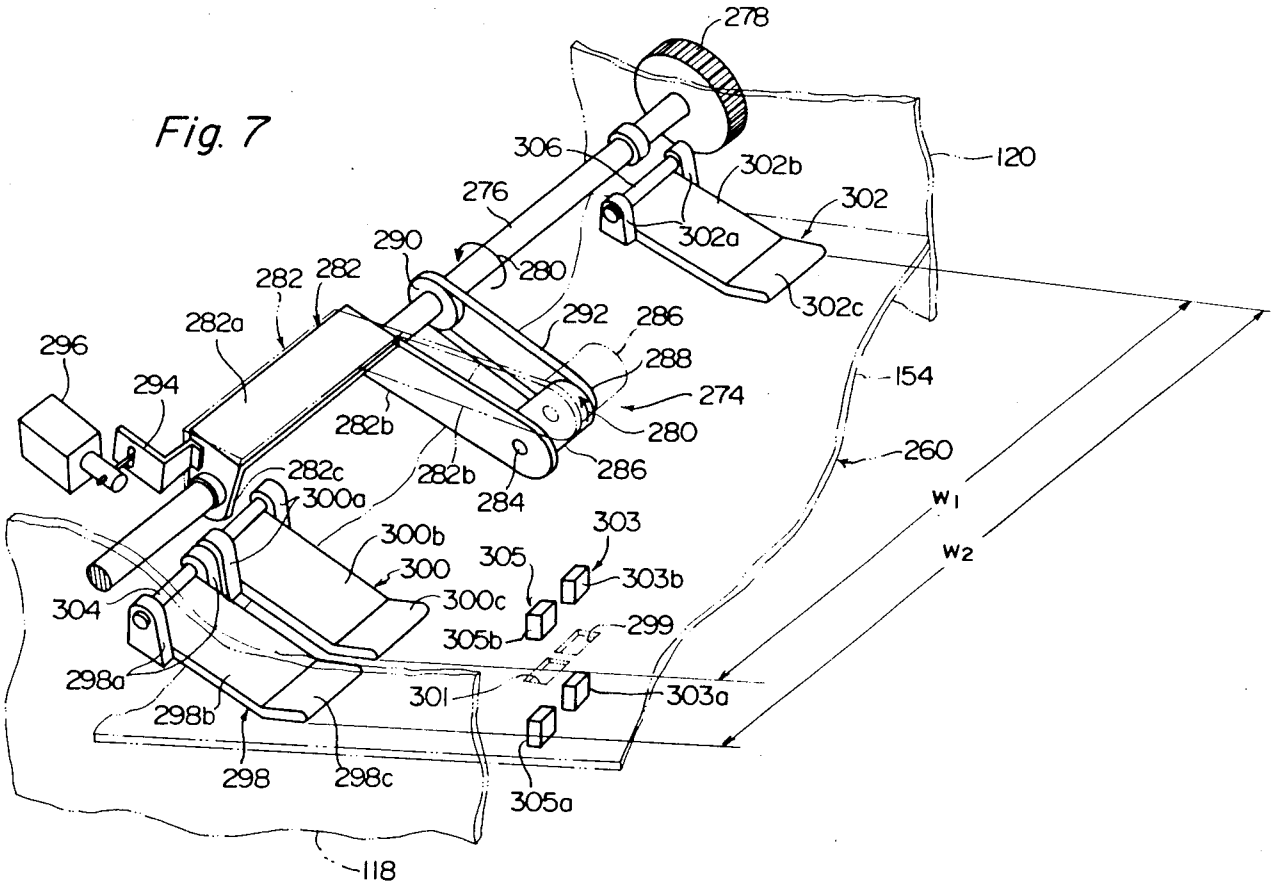
FIG. 7 is a partial perspective view showing a carry-in roller mechanism and a main holding member in the auxiliary unit shown in FIG. 2.

A carry-in roller mechanism 274 is disposed above the rear portion of the paper supporting plate 260. With reference to FIG. 7 in conjunction with FIG. 3, the carry-in roller mechanism 274 includes a supporting shaft 276. The opposite end portions of the supporting shaft 276 are rotatably mounted on the front vertical base plate 118 and the rear vertical base plate 120, respectively. The rear end portion of the supporting shaft 276 is projected rearwardly beyond the rear vertical base plate 120, and an input element 278 which may be a gear is fixed to its projecting end. The input element 278 is drivingly connected to the rotating drive source 172 (FIG. 3) via a suitable drivingly connecting means (not shown), and when the drive source 172 is energized, the supporting shaft 276 is rotated in the direction shown by an arrow 280. A supporting member 282 is mounted on the supporting shaft 276 for rotation relative thereto. The supporting member 282 has a plate portion **282*a* extending along, and above, the supporting shaft 276 and downwardly extending portions 282*b* and 282*c* extending downwardly from both side edges of the plate portion 282*a*. The downwardly extending portions 282*b* and 282*c* are mounted on the supporting shaft 276 for rotation relative thereto. The downwardly extending portion 282*b* extends forwardly (namely, in the paper moving direction), and one end of a shaft 284 is fixed to the free end portion of the downwardly extending portion 282*b*. A carry-in roller 286 is rotatably mounted on the shaft 284. A pulley 288 is formed at one end portion of the carry-in roller 286 integrally therewith. A pulley 290 is fixed to the supporting shaft 276, and an endless belt 292 is wrapped about the pulleys 288 and 290. Thus, the carry-in roller 286 is drivingly connected to the supporting shaft 276. When the rotary driving source 172 is energized, the carry-in roller 286 is rotated in the direction of arrow 280. A rearwardly extending linking piece 294 is fixed to the other downwardly extending portion 282*c*, and the output terminal of an elevating means 296 which may be an electromagnetic solenoid fixed to the inside surface of the front vertical base plate 118 is connected to the linking piece 294. When the elevating means 296 is in the deenergized state, the supporting member 282 is biased clockwise in FIG. 3 by the weight of the supporting member 282 and the carry-in roller 286, and as a result, the carry-in roller 286 is caused to abut against the upper surface of the paper supporting plate 260, as shown in FIGS. 3 and 7. If desired, the supporting member 282 may be elastically biased clockwise in FIG. 3 by a suitable spring means. On the other hand, when the elevating means 296 is energized, the supporting member 282 is pivoted counterclockwise in FIG. 3 to a position shown by a two-dot chain line in FIGS. 3 and 7, and the carry-in roller 286 is elevated a predetermined distance to the topmost position from the upper surface of the paper supporting plate 260**.

With reference to FIGS. 3 and 7, main holding members 298, 300 and 302 are disposed on both sides of the carry-in roller 286 in the illustrated embodiment. As clearly shown in FIG. 7, an inwardly projecting pin 304 is provided in the front vertical base plate 118, and likewise, an inwardly projecting pin 306 is provided in the rear vertical base plate 120. The main holding members 298 and 300 are mounted on the pin 304, and the main holding member 302, on the pin 306. The main holding members 298, 300 and 302 respectively have upwardly projecting pieces **298*a*, 300*a* and 302*a* each at both side portions of their rear end, and these projecting pieces 298*a*, 300*a* and 302*a* are pivotably mounted on the pin 304 and the pin 306, respectively. The main portions 298*b*, 300*b* and 302*b* of the main holding members 298, 300 and 302 extend forwardly (namely in the paper moving direction), and their free end portions 298*c*, 300*c* and 302*c* form a predetermined angle with respect to the main portions 298*b*, 300*b* and 302*b*. Each of the main holding members 298, 300 and 302 is biased clockwise in FIG. 3 by its own weight, The free end portions 298*c*, 300*c* and 302*c* are caused to abut against the upper surface of the paper supporting shaft 260. The widthwise size $w_1$ defined by the main holding members 300 and 302 corresponds to the width of the JIS B5 paper, and the widthwise size $w_2$ defined by the main holding members 298 and 302**, to the width of the JIS A4 paper.

Ahead of the pressing members 298 and 300 is provided a detecting means for detecting the size of the paper sheets stocked in the paper stock means 140. As shown in FIG. 7, openings 299 and 301 are formed in the plate member 154 constituting the paper supporting plate 260, and a light emitting element **303*a* and a light receiving element 303*b* are disposed below and above the opening 299, and the light emitting element 303*a* and the light receiving element 303*b*, in cooperation with each other, constitute a first detector 303. Likewise, a light emitting element 305*a* and a light receiving element 305*b* are disposed below and above the opening 301, and in cooperation with each other, constitute a second detector 305. The opening 299 is located within the widthwise size $w_1$ (the width of the JIS B5 paper), and the opening 301 is located outwardly of the widthwise size $w_1$ and within the widthwise size $w_2$. Hence, when the paper sheets stocked on the paper supporting plate 260 of the paper stock means 140 are of the B5 size, only the first detector 303 detects paper (the light from the light emitting element 303*a* is shut off by the copying paper sheet and does not fall upon the light receiving element 303*b*), and the second detector 305 does not detect paper (the light from the light emitting element 305*a* falls upon the light receiving element 305). On the other hand, when the paper sheets stocked on the paper supporting member 260 of the paper stock means 140 are of the A4 size, both the first detector 303 and the second detector 305 detect paper. When no paper is stocked on the paper supporting plate 260 of the paper stock means 140, both of the first detector 303 and the second detector 205** do not detect paper.

With reference to FIGS. 2 and 3, in the illustrated embodiment, two subsidiary holding members 308 and 310 are disposed in widthwise spaced relationship above the front end portion of the paper supporting plate 260 (and therefore, above the front end portion of the movable supporting plate piece 262). The subsidiary holding members 308 and 310 respectively have main portions **308*a* and 310*a* extending forwardly (i.e., in the paper moving direction) from their rear end portions mounted pivotably on pins 312 (FIG. 3) fixed to the under surface of the front end portion of the cover plate 254 and free end portions 308***b* and 310*b* forming a predetermined angle to the main portions 308*a* and 310*a*. The subsidiary holding members 308 and 310 are also biased clockwise in FIG. 3 by their own weight, and their free end portions 308*b* and 310*b* are caused to abut against the upper surface of the paper supporting plate 260. The positions in the widthwise direction of the subsidiary holding members 308 and 310 are prescribed within the widthwise size $w_1$ defined by the main holding members 298 and 300.

Figure 8:
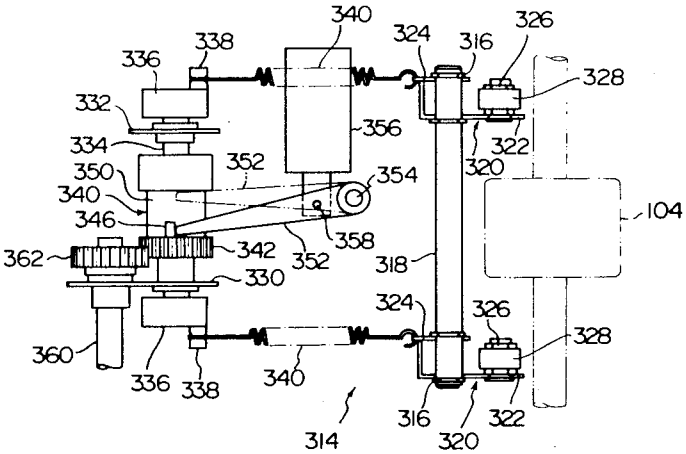
FIG. 8 is a partial top plan view showing the elastic biasing means in the auxiliary unit shown in FIG. 2.

With reference to FIGS. 6 and 8 together with FIG. 3, the paper stock means 140 includes an elastic biasing means 314 for elastically pivoting the movable supporting palte piece 262 defining the front portion of the paper supporting plate 260 counterclockwise in FIG. 3 selectively from a receiving position shown by a solid line in FIG. 3. As shown in FIGS. 6 and 8, a pair of supporting protrusions 316 extending upwardly and spaced from each other a predetermined distance in the widthwise direction are fixed to the front end portion of the bottom wall portion 112 (FIG. 3) of the supporting base plate 110, and a shaft 318 is rotatably mounted on the supporting projections 316. A push-up members 320 is pivotably mounted on each of the opposite end portions of the shaft 318. The push-up member 320 has a first arm portion 322 projecting forwardly and a second arm portion 324 projecting upwardly. A pin 326 is fixed to the free end portion of the first arm portion 322, and a push-up roller 328 is rotatably mounted on the pin 326. To the bottom wall portion 112 (FIG. 3) of the supporting base plate 112 (FIG. 3) are also fixed supporting protrusions 330 and 332 which are spaced from each other a predetermined distance in the widthwise direction and upwardly project rearwardly of the pair of supporting protrusions 316 by a predetermined distance. A rotating shaft 334 is rotatably mounted on the supporting protrusions 330 and 322. The opposite end portions of the rotating shaft 334 project beyond the supporting protrusions 330 and 332 respectively, and nearly oval movable members 336 are fixed respectively to the projecting ends of the rotating shaft 334. A pin 338 is provided in each of the movable members 336 at a position excentric to the rotating shaft 334. A tension spring 340 is stretched between the pin 338 and the second arm portion 324 of each of the push-up members 320. Furthermore, a gear 342 is rotatably mounted on the rotating shaft 334, and a spring clutch means 344 for connecting the gear 342 and the rotating shaft 334 selectively is also mounted on the rotating shaft 334. The spring clutch means 344 may be of a known type and has a control sleeve 350 on which two engaging protrusions 346 and 348 are formed at an interval of 180 degrees in the circumferential direction. In relation to the control sleeve 350, a controlling member 352 is disposed. One end of the controlling member 325 is pivotably mounted on a pin 354 provided in the bottom wall portion 112 (FIG. 3) of the supporting base plate 110. An actuating means 356 which may be an electromagnetic solenoid is mounted on the bottom wall portion 112 of the supporting base plate 110, and the output terminal of the actuating means 354 is linked to the controlling member 352 via a pin 358. When the actuating means 356 is in the deenergized state, the controlling member 352 is held at the first position shown by a solid line. When the actuating means 356 is energized, the controlling member 352 is held at a second position shown by a two-dot chain line. At the first position, the free end of the controlling member 352 is positioned against one engaging protrusion 346 of the control sleeve 350, and at the second position, the free end of the controlling member 352 is positioned against the other engaging protrusion 348 of the control sleeve 350. A shaft 360 is rotatably mounted between the supporting protrusion 330 and the front vertical base plate 118. The inside end of the shaft 360 projects beyond the supporting protrusion 330, and a gear 362 in mesh with the gear 342 is fixed to this inside end. The outside end of the shaft 360 projects outwardly beyond the front vertical base plate 118, and an input element 364 which may be a gear is fixed to the outside end of the shaft 360. The input element 364 is drivingly connected to the rotating drive source 172 (FIG. 3) via a suitable drivingly connecting means (not shown). When the drive source 172 is energized, the shaft 360 and the gear 362 are rotated in the direction shown by an arrow 363, and therefore, the gear 342 is rotated in the direction shown by an arrow 366.

The operation of the elastic biasing means 314 will be described. When the actuating means 356 is deenergized and the controlling member 352 is held at the first position shown by the solid line, the rotation of the gear 342 is transmitted to the rotating shaft 334 via the spring clutch means 344 kept in the linked state. As a result, the rotating shaft 334 and the control sleeve 350 of the spring clutch means 344 are rotated to an angular position shown by a solid line in FIG. 6 in the direction shown by an arrow 366. One engaging protrusion 346 of the control sleeve 350 of the spring clutch means 344 abuts against the free end of the control member 325 whereby the rotation of the control sleeve 350 in the direction of arrow 366 is hampered and therefore, the spring clutch means 344 is kept in a first linking-cancelled state. As a result, the rotating shaft 334 and the movable member 336 fixed to it are held at an angular position shown by a solid line in FIG. 6 (a non-operating position). At the non-operating position, the tension spring 340 stretched between the pin 338 in the movable member 336 and the second arm portion 324 of the push-up member 320 is in a free condition (not taut), and the push-up member 320 is held at a lowered position shown by a solid line in FIGS. 3 and 6. As clearly shown in FIG. 3, when the push-up member 320 is held at the lowered position, the push-up roller 328 mounted on the free end portion of the first arm portion 322 of the push-up member 320 makes contact with, or is positioned slightly below, the under surface of the movable supporting plate piece 262 held at the receiving position shown by a solid line. Hence, the movable supporting plate piece 262 remains kept at the receiving position. On the other hand, when the actuating means 356 is energized and the controlling member 352 is held at the second position shown by a two-dot chain line, the free end of the controlling member 352 is brought out of abutment against the engaging protrusion 346 of the control sleeve 350 of the spring clutch means and the control sleeve 350 is permitted to rotate in the direction of arrow 366. The spring clutch means 344 is thus maintained in the linked state. Consequently, the rotation of the gear 342 is transmitted to the rotating shaft 334 via the spring clutch means 344, and the rotating shaft 334 and the control sleeve 350 are rotated to an angular position shown by a two-dot chain line in FIG. 6. As a result, the other engaging protrusion 348 of the control sleeve 350 of the spring clutch means 344 abuts against the free end of the controlling member 352 whereby the rotation of the control sleeve 350 in the direction of arrow 366 is hampered, and therefore the spring clutch means 344 is kept in a second linking-cancelled state. Consequently, the rotating shaft 334 and the movable member 336 fixed to it are held at an angular position shown by a two-dot chain line in FIG. 6 (an operating position). When the movable member 336 is thus rotated to the operating position from the non-operating position described above, the push-up member 320 is pivoted counterclockwise in FIG. 3 via the tension spring 340. As a result, as shown by a two-dot chain line in FIGS. 3 and 6, the push-up roller 328 mounted on the free end portion of the first arm portion 322 of the push-up member 320 acts on the movable supporting plate piece 262 and pivots it counterclockwise in FIG. 3. As will be made clear hereinafter, when the auxiliary unit 108 is loaded in position on the electrostatic copying apparatus 2 (FIG. 1), the delivery roller 104 of the electrostatic copying apparatus is positioned at the opening 256 constituting the outlet portion 142, and therefore, the pivoting of the movable supporting plate piece 262 and the paper layer existing on it in the counterclockwise direction in FIG. 3 is restricted as a result of the paper abutting against the delivery roller 104. This restriction causes stretching of the tension spring 340 by a required length. Consequently, the uppermost paper in the paper layer present on the movable supporting plate piece 262 is pressed elastically by the delivery roller 104.

The following fact should be noted with regard to the elastic biasing means 314 described above. It might be possible to connect the output terminal of the actuating means 356 directly to the movable member 336 in order to hold the movable member 336 selectively at the non-operating position and the operating position. In order to achieve this connection, however, the actuating means 356 should be considerably powerful so that the movable member 336 is kept accurately in the operating position (shown by the two-dot chain line) against the elastic force of the stretched tension spring 340. The actuating means 356 therefore becomes large-sized and expensive, and the power consumption increases. In the elastic biasing means 314 described above, a sufficient power generated by the rotary driving source 172 (FIG. 3) which may be an electric motor is effectively utilized in holding the movable member 336 at the operating position. The actuating means 356 needs only to control the linking of the spring clutch means 344 and its cancellation, and may be a small-sized and inexpensive one whose power consumption is low.

Figure 9:
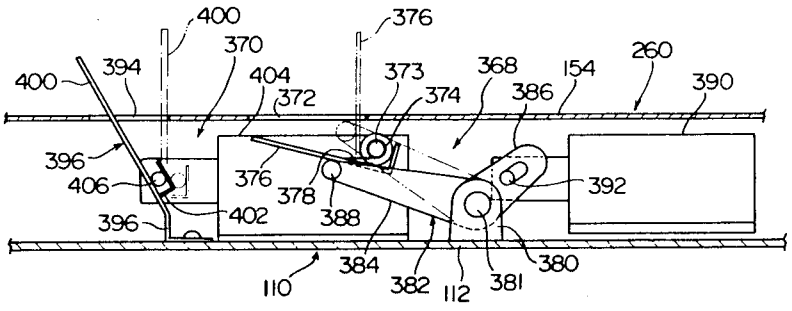
FIG. 9 is a partial sectional view showing the first and second widthwise moving mechanisms in the auxiliary unit shown in FIG. 2.

In the illustrated embodiment, the front vertical base plate 118 and the rear vertical base plate 120 are projected up-wardly beyond the upper surface of the paper supporting plate 260, as is clearly seen from FIG. 6. As will be made clear hereinafter, the rear vertical base plate 120 functions as a restricting plate for restricting one side edge of the copying paper fed to the paper supporting plate 260. With reference to FIGS. 6 and 9, the illustrated auxiliary unit 108 also has disposed therein a first widthwise moving mechanism 368 and a second widthwise moving mechanism 370 for moving the copying paper fed onto the paper supporting plate 260 in the widthwise direction toward the rear vertical base plate 120 and thereby causing one side edge of the paper to abut substantially against the rear vertical base plate 120.

The first widthwise moving mechanism 368 will be described. A rectangular opening 372 is formed in the plate member 154 defining the rear portion of the paper supporting plate 260. On the other hand, a suitable upwardly projecting supporting protrusion (not shown) is fixed to the bottom wall portion 112 of the supporting base plate 110, and a shaft 373 extending in the front-rear direction (in a direction perpendicular to the sheet surface in FIG. 9) is fixed to the supporting protrusion, and a sleeve member 374 is rotatably mounted on the shaft 373. A movable restricting plate 376 is fixed to the sleeve member 374. A spring member 378 for elastically biasing the movable restricting plate 376 counterclockwise in FIG. 9 is provided between the shaft 373 and the movable restricting plate 376. An upwardly projecting supporting protrusion 380 is also fixed to the bottom wall portion 112 of the supporting base plate 110, and a nearly L-shaped member 382 is pivotably mounted on the supporting protrusion 380 via a pin 382. The member 382 has a first arm portion 384 and a second arm portion 386. A rearwardly extending pin 388 is fixed to the free end of the first arm portion 384. On the other hand, the output terminal of an actuating means 390 which may be an electromagnetic solenoid mounted on the bottom wall portion 112 of the supporting base plate 110 is linked to the free end portion of the second arm portion 386 via a pin 392. When the actuating means 390 is in the deenergized state in the first widthwise moving mechanism 368, the member 382 is held at a non-operating position shown by a solid line. In this state, the movable restricting plate 376 is biased counterclockwise in FIG. 9 by the elastic biasing action of the spring member 378, and held elastically at a non-operating position (the position shown by a solid line in FIGS. 6 and 9) at which it abuts against the pin 388 fixed to the first arm portion 384 of the member 382. As is clear from FIG. 9, when the movable restricting plate 376 is held at the non-operating position, it is positioned below the opening 372. When the actuating means 390 is energized, the member 382 is pivoted to an operating position shown by a two-dot chain line. As a result, the movable restricting member 376 is pivoted clockwise in FIG. 9 by the pin 388 fixed to the first arm portion 384 of the member 382 against the elastic biasing action of the spring member 378 and held at an operating position shown by a two-dot chain line in FIGS. 6 and 9. Consequently, the upper portion of the movable restricting plate 376 projects substantially vertically upwardly through the opening 372. The distance between the upper portion of the movable restricting plate 376 at the operating position and the rear vertical base plate 120 corresponds to the width of the JIS B5 size paper.

The second widthwise moving mechanism 370 will now be described. A rectangular opening 394 is also formed outwardly of the opening 372 in the widthwise direction in the plate member 154 defining the rear portion of the paper supporting plate 160. On the other hand, a movable restricting plate 396 formed of spring steel is fixed to the bottom wall portion 112 of the supporting base plate 110. As clearly shown in FIG. 9, the movable restricting plate 396 has a bottom portion 398 extending upwardly substantially vertically and a main portion 400 extending from the bottom portion 398 upwardly outwardly (to the left in FIG. 9) in the widthwise direction. The main portion 400 projects upwardly through the opening 394. An L-shaped member 402 is fixed to the inside surface of the main portion 400 in the widthwise direction, and a pin 406 fixed to the output terminal of an actuating means 404 which may be an electromagnetic solenoid and mounted on the bottom wall portion 112 of the supporting base plate 110 is inserted between the member 402 and the main portion 400. When the actuating means 404 is in the deenergized state in the second widthwise moving mechanism 370, the pin 406 exerts no action on the main portion 400 of the movable restricting plate 396, and the main portion 400 is held at a non-operating position shown by a solid line in FIGS. 6 and 9. On the other hand, when the actuating means 404 is energized, the pin 406 is moved inwardly (to the right in FIG. 9) in the widthwise direction, whereupon the main portion 400 of the movable restricting plate 396 is elastically displaced to an operating position shown by a two-dot chain line in FIGS. 6 and 9. At this operating position, the main portion 400 projects upwardly substantially vertically through the opening 394. The distance between the main portion 400 at the operating position and the rear vertical base plate 120 corresponds to the width of the JIS A4 paper.

Operation of the Auxiliary Unit

The operation of the auxiliary unit 108 described above will now be described.

As stated already, the electrostatic copying apparatus 2 shown in FIG. 1 can by itself perform only an ordinary copied image forming mode. When it is desired to perform the both surface image forming mode and the overlapping image forming mode in addition to the ordinary image forming mode by using this electrostatic copying apparatus 2, the paper cassette 94 loaded in the space 86 formed in the lower portion of the housing 4 of the electrostatic copying apparatus 2 and the receiving tray 84 and the pair of guide plates 74 mounted on the left end portion of the housing 4 are removed. Then, as shown in FIG. 3, the auxiliary unit 108 is loaded into the space 86 in place of the paper cassette 94 (in FIG. 3, part of the electrostatic copying apparatus 2 is shown by a two-dot chain line). It will be easily understood by referring to FIG. 3 that the auxiliary unit 108 is mounted in position on the electrostatic copying apparatus 2 by inserting its front housing portion 122 into the space 86 formed in the housing 4 of the electrostatic copying apparatus 2 and causing the front end of the front housing portion 122 to abut against the member 92 provided ahead (to the right in FIG. 3) of the space 86. As a result, the inlet portion 124 of the auxiliary unit 108 is connected to the paper conveying passage 52 of the copying apparatus 2, and the outlet portion 142 of the auxiliary unit 108 is connected to the upstream end of the paper feed passage 96 of the copying apparatus. More specifically, as shown in FIG. 3, the front end portions of the upper movable guide plate 228 and the lower guide plate 230 provided in the inlet portion 124 project into the housing 4 of the copying apparatus 2 and are positioned against the pair of discharge rollers 72 provided within the housing 4. Furthermore, the opening 256 constituting the outlet portion 142 is positioned against the delivery roller 104 provided within the housing 4 of the copying apparatus 2.

Figure 10:
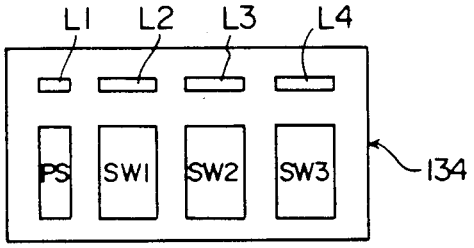
FIG. 10 is a top plan view showing an operating panel in the auxiliary unit shown in FIG. 2.
Figure 11:
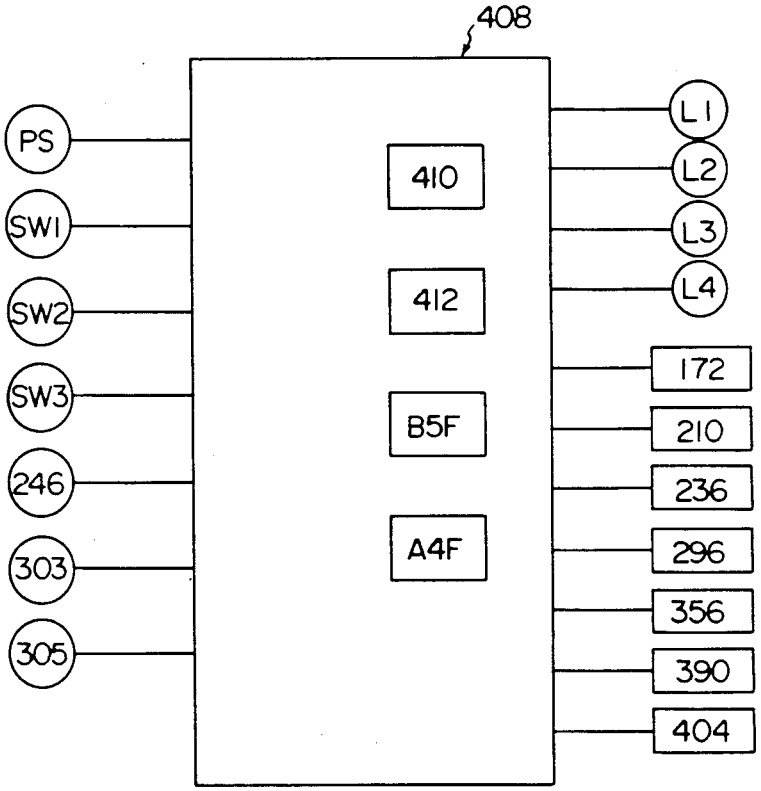
FIG. 11 is a block diagram showing main control elements provided in the auxiliary unit shown in Figure 2.

As already stated with reference to FIG. 2, the operation panel 134 is disposed in the stepped portion formed in the cover 130 of the auxiliary unit 108. As illustrated in FIG. 10, the power supply switch PS and switches SW1, SW2 and SW3 selectively operated manually are provided on the operating panel 134. Furthermore, display lamps L1, L2, L3 and L4 corresponding to the switches PS, SW1, SW2, and SW3 are provided on the operating panel 134. The operation of the auxiliary unit 108 is controlled as shown below by a control means 498 (FIG. 11), which may be constructed of a microprocessor, according to the selective closing of the switches SW1, SW2 and SW3.

With reference mainly to FIG. 3 together with FIGS. 12A to 12C which are flow charts showing the operating procedure of the auxiliary unit 108, the control operation will be described. In the case of using the auxiliary unit 108, the power switch PS (FIG. 10) is manually closed (whereupon the display lamp L1 is turned on). Then, either one of the switches SW1, SW2 and SW3 (FIG. 10) is selectively closed manually according to which of the ordinary image forming mode, both surface image forming mode and overlapping image forming mode is to be performed.

Ordinary Image Forming Mode

When the ordinary image forming mode (the mode in which a copied image of a single document is formed on one surface of a copying paper sheet) is to be performed, the switch SW3 (FIG. 10) is manually closed. In this case, it is determined in step n-1 whether the switch SW1 (FIG. 10) is closed or not, and then in step n-2, it is determined whether the switch SW2 (FIG. 10) is closed or not. Then, in step n-3, it is determined whether the switch SW3 is closed or not. Before the switch SW3 is closed, step n-3 is followed directly by step n-4 which the lamp L4 is turned on. Then, step n-5 sets in. In step n-5, if any one of the rotary driving source 172 and the actuating means 236, 210, 296, 356, 390 and 404 is in the energized state, it is deenergized. Then, the operation returns to step n-1. On the other hand, after the switch SW3 has been closed, step n-3 is followed by step n-6, and in step n-6, it is determined whether or not copying paper sheets having a JIS B5 size are in stock in the paper stock means 140 (the determination is based on the outputs of the first detector 303 and the second detector 305 shown in FIG. 7). Since no paper is in stock in the paper stock means 140, step n-6 is followed by step n-7, and in step n-7, it is determined whether or not copying paper sheets having the JIS A4 size are in stock in the paper stock means 140 (the determination is also based on the outputs of the first detector 303 and the second detector 305 shown in FIG. 7). Since no paper is in stock in the paper stock means 140, step n-7 is followed by step n-4.

In the aforesaid state where the display lamp L4 is turned on, the rotary driving source 172 in the auxiliary unit 108 is in the deenergized state; the actuating means 236 is in the deenergized state, and the upper movable guide plate 228 in the inlet portion 136 is held at the non-introduction position shown by the two-dot chain line; the actuating means 210 is in the deenergized state, and the pressing means 192 is held at the non-introduction position shown by the two-dot chain line; the elevating means 296 (FIG. 7) is in the deenergized state and the carry-in roller 286 is at the position shown by the solid line; and the actuating means 356 (FIG. 6) is in the deenergized state and the push-up members 320 are held at the lowered positions shown by the solid lines and therefore the movable supporting plate piece 262 is held at the receiving position shown by the solid line. Furthermore, the actuating means 390 and 404 shown in FIG. 6 are also in the deenergized state in the aforesaid state, and the movable restricting plates 376 and 400 are held at the non-operating positions shown by the solid lines in FIG. 6.

As clearly shown in FIG. 3, when the upper movable guide plate 228 of the inlet portion 136 is positioned at the non-introduction position shown by the two-dot chain line, not only the upstream end of the lower guide plate 230 but also the upstream end of the upper movable guide plate 228 is positioned below the nipping site of the pair of discharge rollers 72 in the copying apparatus 2. The projecting portion 238 (FIG. 2) formed at the downstream end of the upper movable guide plate 228 is located within the cut 240 (FIG. 2) formed at the upstream end of the cover plate 144, and the upper surface of the projecting portion 238 is positioned on substantially the same level as, or slightly above, the upper surface of the cover plate 144. Hence, a copying paper sheet having a copied image formed on one surface thereof by being fed from the paper feed means 76 (FIG. 1) in the copying apparatus 2 into the paper conveying passage 52 (FIG. 1) and conveyed through the paper conveying passage 52 is moved from the pair of discharge rollers 72 along the upper surface of the upper movable guide plate 228, and discharged onto the upper surface of the cover plate 144, i.e. its paper receiving surface. As a result, an ordinary copy having a copied image of a single document formed on its one surface is obtained. In this ordinary image forming mode, the auxiliary unit 108 is only such that the upper surface of the cover plate 144 functions as a receiver tray for gathering copies.

Both Surface Image Forming Mode

When the both surface image-forming mode (the mode in which a copied image of a document is formed on one surface of a copying paper sheet and then a copied image of another document is formed on the other surface of the paper) is to be carried out, the switch SW1 (FIG. 10) is manually closed. In this case, the operation goes to step n-8 from step n-1, and the display lamp L2 is turned on. Then the operation goes to step n-9, and the actuating means 236 is energized to hold the upper movable guide plate 228 in the inlet portion 136 at the introduction position shown by the solid line. As shown in FIG. 3, when the upper movable guide plate 228 is held at the introduction position, the upstream end of the upper movable guide plate 228 is positioned above the nipping site of the pair of discharge rollers 72 in the copying apparatus 2, and the upstream end of the lower guide plate 230 is positioned below the nipping site of the pair of discharge rollers 72. The downstream end of the upper movable guide plate 228 is positioned above the nipping site of the introduction rollers, i.e. rollers 176 and 178, located at the upstream end of the curved reversal passage 156 in the auxiliary unit 108, and below the cover plate 144. The downstream end of the lower guide plate 230 is positioned below the nipping position of the rollers 176 and 178. Hence, a copying paper sheet having a copied image formed on its one surface (upper surface) by being fed from the paper feed means 76 (FIG. 1) in the copying apparatus 2 into the paper conveying passage 52 (FIG. 1) and conveyed through the paper conveying passage 52 is conducted between the upper movable guide plate 228 and the lower guide plate 230 from the pair of discharge rollers 72 and sent to the nipping site of the rollers 176 and 178 through the guide plates 228 and 230.

Then, step n-10, sets in, and in step n-10, it is determined whether or not the detecting means 246 disposed in the inlet portion 136 has detected the leading edge of the copying paper (namely, whether or not the leading edge of the paper has reached and closed the detecting means 246). When the detecting means 246 has detected the leading edge of the copying paper, step n-11 sets in, and a paper stock number counter 410 (FIG. 11) built in the control means 408 counts up. Then, step n-12 sets in, and a paper size detecting timer 412 (FIG. 11) built in the control means 408 starts to measure the time. Then, step n-13 sets in, and in step n-13, the rotary driving source 172 is energized to rotate the rollers 176, 178, 180, 216, 218 and 220 in the direction of arrow 174, the roller 196 in the reverse direction moving means 190 in the direction shown by an arrow 198, and the carry-in roller 286 in the carry-in roller mechanism 274 in the direction shown by an arrow 280. Hence, the copying paper which has been conducted to the nipping site of the rollers 176 and 178 through the space between the upper movable guide plate 228 and the lower guide plate 230 is introduced into the curved reversal passage 156 by the action of the rollers 176 and 178 and move in the reversal passage 156 in the direction shown by an arrow 212. When the paper is introduced into the reversal passage 156 by the action of the rollers 176 and 178, the intermediate protrusion 184 projecting beyond the circumferential surface of the roller 176 acts on the leading edge portion of the paper passing through the nipping site of the rollers 176 and 178 to displace it slightly upwardly, and thus surely prevents the leading edge of the paper from moving downwardly along the circumferential surface of the roller 176 and being introduced into the nipping site of the rollers 176 and 180 located at the upstream end of the short-circuit passage 158. The copying paper introduced into the reversal passage 156 and moved in the direction of arrow 212 advances between the guide plate 150 and the roller 216, and further moved in the direction of arrow 212 by the action of the roller 216. On the other hand, the roller 196 in the reverse direction moving means 190 is rotated in the direction shown by an arrow 198, but since slippage is generated between the paper and the roller 196, the movement of the paper in the direction of arrow 212 is never hampered by the roller 196.

Then, step n-14 sets in, and it is determined whether or not the detecting means 246 disposed in the inlet portion 136 has detected the trailing edge of the copying paper (namely whether the trailing edge of the paper has passed and opened the detecting means 246). When the detecting means 246 has detected the trailing edge of the copying paper, step n-15 sets in. In step n-15, it is determined whether or not the paper detecting timer 412 (FIG. 11) which starts measuring the time in step n-12 has measured the time exceeding a predetermined time. When the copying paper is of the JIS B5 size, the time required from the arrival of the leading edge of the paper at the detecting means 246 until the trailing edge of the paper has gone past the detecting means 246 is shorter than the aforesaid predetermined time. On the other hand, when the copying paper is of the JIS A4 size, the time required from the arrival of the leading edge of the paper at the detecting means 246 until the trailing edge of the paper has gone past the detecting means 246 is longer than the predetermined time. When the paper has the JIS A4 size and therefore the time measured by the paper detecting timer 412 is larger than the aforesaid predetermined time, step n-16 sets in, and in step n-16, the paper detecting time 412 is reset. Then, step n-17 sets in, and in step n-17, an A4 flag A4F (FIG. 11) built in the control means 408 is set at "1". When the paper has the JIS B5 size and therefore the time measured by the paper detecting timer 412 is shorter than the aforesaid predetermined time, step n-18 sets in, and in step n-18, the paper detecting timer 412 is reset. Then, step n-19 sets in, and in step n-19, a B5 flag B5F (FIG. 11) built in the control means 408 is set at "1". After step n-17 or n-19, step n-20 sets in, and in step n-20, it is determined whether or not the switch SW1 is closed. Since SW1 is closed (the both surface image forming mode is selected), step n-21 then sets in. In step n-21, there is waiting for a predetermined period of time. This predetermined period of time is slightly longer than the time required from the passing of the trailing edge of the paper past the detecting means 246 until it passes the nipping site of the rollers 176 and 178. Hence, during the above waiting for the predetermined period of time, the trailing edge of the paper passes the nipping site of the rollers 176 and 178. At this time, the intermediate protrusions 184 projecting beyond the circumferential surface of the roller 176 act on the trailing edge of the paper and force it downwardly toward the guide plate 150. As a result, when the paper is reversed in the moving direction in the manner to be described, the trailing edge of the paper is not nipped by the rollers 176 and 178, but is surely nipped by the rollers 176 and 180.

Then, step n-22 sets in, and in step n-22, the actuating means 210 is energized to lower the pressing means 192 to the operating position shown by the two-dot chain line. Consequently, the roller 208 in the pressing means 192 presses the paper existing below it against the roller 196 rotating in the direction of arrow 198. Accordingly, the paper which has been moved in the direction of arrow 212 is now moved by the roller 196 in an opposite direction, i.e. the direction shown by arrow 214, and its leading edge (the trailing edge during movement in the direction of arrow 212) is introduced into the nipping site of the rollers 176 and 180, namely the upstream end of the short-circuit passage 158. At this time, slippage is generated between the roller 216 rotating in the direction of arrow 174 and the copying paper. Then, step n-23 sets in, and in step n-23, there is waiting for a predetermined period of time. This predetermined period of time is slightly longer than the time required for the leading edge of the paper moved in the opposite direction (the direction of arrow 214) to reach the nipping site of the rollers 176 and 180. During the waiting for the predetermined time, the leading edge portion of the paper is nipped by the rollers 176 and 180, and the paper is moved in the direction of arrow 214 by the action of the rollers 176 and 180. Then, step n-24 sets in, and in step n-24, the actuating means 210 is deenergized to elevate the pressing means 192 to the non-operating position shown by the solid line.

Then, step n-25 sets in, and in step n-25, there is waiting for a predetermined period of time. This predetermined time is slightly longer than the time required for the leading edge of the paper which has been fed to the paper stock means 140 to abut against the front wall portion 114 of the supporting base plate 110 (i.e., the paper leading edge restricting plate). During this waiting for the predetermined time, the paper is conveyed through the short-circuit passage 158 by the action of the rollers 176 and 180 and introduced into the paper stock means 140. It will be understood by referring to FIGS. 3 and 4 that at this time, the paper is made slightly wavy in the widthwise direction by the cooperative action of the intermediate protrusions 184 projecting beyond the circumferential surface of the roller 176 and the lower protrusion 188 projecting beyond the circumferential surface of the roller 180, whereby the stiffness of the paper in the moving direction is increased and the paper can be accurately introduced into the paper stock means 140 through the short-circuit paysage 158. The paper which has been introduced into the paper stock means 140 advances along the upper surface of the paper supporting plate 260 and then below the carry-in roller 286 lowered to the position shown by the solid line (or a position above the position shown by the solid line by the thickness of the paper layer stocked in the paper stock means 140) and being rotated in the direction of arrow 280. As a result, the paper is further advanced by the action of the carry-in roller 286 and its leading edge abuts against the front wall portion 114 of the supporting base plate 110. After the leading edge of the paper has abutted against the front wall portion 114, further advancing of the paper is hampered, and therefore, slippage is generated between the paper and the carry-in roller 286. Thus, after the leading edge has abutted against the front wall portion 114, the carry-in roller 286 continues to be lowered to the position shown by the solid line for some time. Hence, it is presumed that when the paper has low stiffness, the paper is curved upwardly immediately ahead of the carry-in roller 286, and then the trailing end of the paper goes past the carry-in roller 286 and moves upwardly of the carry-in roller 286 (whereupon the paper fed next to the paper stock means 140 comes below the previous paper). Occurrence of this impermissible accident, however, can be surely circumvented by the present invention since in the auxiliary unit 180 illustrated, the main holding member 298, 300 and 302 (FIG. 7) are disposed on both sides of the carry-in roller 286 in the widthwise direction and hold the paper against the upper surface of the paper supporting plate 260. It will also be imagined that since the carry-in roller 286 continues to be lowered to the position shown by the solid line, the paper having low stiffness is curved upwardly even immediately at the back of the front wall portion 114, and then the leading edge portion of the paper advances between the front edges of the paper previously stocked and the paper supporting plate 260 and the front wall portion 114. Occurrence of this impermissible accident, however, can be surely circumvented by this invention since in the illustrated auxiliary unit 108, the subsidiary holding members 303 and 310 (FIG. 2) are disposed above the front end portion of the paper supporting plate 260 and hold the paper against the upper surface of the paper supporting plate 260. If desired, during the waiting for the predetermined period of time in step n-25 and after the leading edge of the paper has advanced to a position downstream of the movable restricting plate 376 or 396, the actuating means 390 or 404 may be energized several times temperarily to hold the movable restricting plate 376 or 396 at the operating position shown by the two-dot chain line in FIGS. 6 and 9 several times temporarily and thus perform a pre-operation for the operation of determining the widthwise position of the paper to be described.

Then, step n-26 sets n, and in step n-26, the actuating means 296 (FIG. 7) is energized to elevate the carry-in roller 286 to the topmost position shown by the two-dot chain line. Then, step n-27 sets in, and it is determined whether a B5 flag B5F (FIG. 11) in the control means 408 is "1" or not. When the B5 flag B5F is "1", step n-28 sets in, and in step n-28, the actuating means 390 (FIGS. 6 and 9) is energized to hold the movable restricting plate 376 at the operating position shown by the two-dot chain line in FIGS. 6 and 9. It will be easily understood by referring to FIGS. 6 and 9 that as a result, the movable restricting plate 376 acts on the front side edge of the JIS B5 size paper fed to the paper supporting plate 160 to force the paper to the right in FIG. 9 and the rear side edge of the paper is caused to abut substantially against the rear vertical base plate 120 (i.e., the paper one side edge restricting plate). Thus, the paper is set accurately at a predetermined widthwise position. Then, step n-29 sets in, and in step n-29, there is waiting for a predetermined period of time which may be short. Thereafter, step n-30 sets in, and in step n-30, the actuating means 390 (FIGS. 6 and 9) are deenergized to return the movable restricting plate 376 to the non-operating position shown by the solid line in FIGS. 6 and 9. Then step n-31 sets in, and in step n-31, the B5 flag B5F (FIG. 11) is reset. On the other hand, when in step n-27, the B5 flag B5F is not "1" (in which case, A4F is "1"), step n-32 sets in, and in step n-32, the actuating means 404 (FIGS. 6 and 9) is energized to hold the movable restricting plate 396 at the operating position shown by the two-dot chain line in FIGS. 6 and 9. As a result, as in the case of the paper having the JIS B5 size, the movable restricting plate 376 acts on the front side edge of the JIS A4 size paper fed to the paper supporting plate 160 to force the paper to the right in FIG. 9 and cause the rear side edge of the paper to abut substantially against the rear vertical base plate 120 (i.e., the paper one side edge restricting plate). As a result, the paper is surely set at a predetermined widthwise position. Then., step n-33 sets in, and in step n-33, there is waiting for a predetermined period of time which may be short. Thereafter, step n-34 sets in, and in step n-34, the actuating means 404 (FIGS. 6 and 9) is deenergized to return the movable restricting plate 396 to the non-operating position shown by the solid line in FIGS. 6 and 9. Then, step n-35 sets in, and in step n-35, the A4 flag A4F (FIG. 11) is reset.

Step n-31 or step n-35 is followed by step n-36, and in step n-36, the actuating means 296 (FIG. 7) is deenergized to lower the carry-in roller 286 to the position shown by the solid line (or a position above the position shown by the solid line by the thickness of the paper layer already stocked in the paper stock means 140). In this way, the required number of copying paper sheets having the JIS B5 size or the JIS A4 size are stocked in the paper stock means 140. Thereafter, step n-37 sets in and in step n-37, it is determined whether or not the counted value of the paper stock number counter 410 of the control means 408 has reached a predetermined number. This predetermined number is the allowable number of paper sheets that can be stocked in the paper stock means 140. When the counted value of the paper stock number counter 410 does not reach the predetermined value, the operation returns to step n-1. On the other hand, when in step n-37, the counted value of the counter 410 has reached the predetermined number, step n-38 sets in. In step n-38, the actuating means 236 is deenergized to return the upper movable guide plate 228 of the inlet portion 136 to the non-introduction position shown by the two-dot chain line. Thus, copying paper sheets in numbers exceeding the allowable number are prevented from being introduced into the curved reversal passage 156 from the inlet portion 136, and the paper from the pair of discharge rollers 72 in the electrostatic copying apparatus 2 is moved along the upper surface of the upper movable guide plate 228 held at the non-introduction position shown by the two dot-chain line and discharged onto the upper, receiving surface of the cover plate 144.

After the required number of copying paper sheets of the JIS B5 or JIS A4 size have been stocked in the paper stock means 140, the switch SW3 (FIG. 10) is manually closed whereby the switch SW1 closed up to this time is opened. Thus, when the copying paper sheets in stock have the JIS B5 size, step n-6 is followed by step n-39. In step n-39, the actuating means 390 (FIGS. 6 and 9) is energized to hold the movable restricting plate 376 at the operating position shown by the two-dot chain line in FIGS. 6 and 9. As a result, the widthwise position of the copying paper sheets is restricted when the copying paper having the JIS B5 size is discharged from the paper stock means 140 in the manner to be described hereinafter. When the copying paper sheets in stock have the JIS A4 size, step n-7 is followed by step n-40. In step n-40, the actuating means 404 (FIGS. 6 and 9) is energized to hold the movable restricting plate 396 at the operating position shown by the two-dot chain line in FIGS. 6 and 9. As a result, the widthwise position of the paper is restricted when the paper of the JIS A4 size is discharged fromthe paper stock means 140 in the manner to be described hereinafter.

Step n-39 or n-40 is then followed by step n-41. In step n-41, the actuating means 296 (FIG. 7) is energized to elevate the carry-in roller 286 to the topmost position shown by the two-dot chain line. Then, step n-42 sets in, and in step n-42, the actuating means 236 is energized. If at this time, the upper movable guide plate 228 in the inlet portion 136 is at the introduction position shown by the solid line, the actuating means 236 is deenergized to return the upper movable guide plate 228 to the non-introduction position shown by the two-dot chain line. Furthermore, when the rotary driving source 172 is in the deenergized state, it is energized. Then, step n-43 sets in, and in step n-43, the actuating means 356 (FIGS. 6 and 8) is energized to elevate the pressing members 320 of the elastic biasing means 314. Hence, the movable supporting plate piece 262 defining the front half portion of the paper supporting plate 260 is elevated as shown by the two-dot chain line in FIG. 3, and the uppermost paper in the paper layer of the movable supporting plate piece 262 is pressed elastically against the delivery roller 104 of the electrostatic copying apparatus 2. Then, step n-44 sets in, and in step n-44, the paper stock number counter 410 of the control means 408 is reset. Then, the operation returns to step n-1.

After the movable supporting plate piece 262 has been elevated as shown by the two-dot chain line in FIG. 3 and the uppermost paper of the paper layer on the movable supporting plate piece 262 has been elastically pressed against the delivery roller 104 in step n-43, the delivery roller 104 is rotated counterclockwise in FIG. 3 by, for example, closing a copying switch (not shown) disposed in the electrostatic copying apparatus 2. As a result, the topmost paper is discharged from the paper stock means 104 through the outlet portion 142, introduced into the paper feed passage 96 (FIG. 1) of the copying apparatus 2 and then introduced into the paper conveying passage 52 through the paper feed passage 96. It will be easily understood by referring to FIG. 1 that during conveyance through the curved paper feed passage 96, the paper is turned inside out, and conveyed through the paper conveying passage 52 with its one surface bearing a copied image facing downward. During this conveyance, an image of a document is formed on the other surface (upper surface) of the paper. The paper is then guided from the pair of discharge rollers 72 to the upper surface of the upper movable guide plate 228 held at the non-introduction position shown by the two-dot chain line in FIG. 3 and discharged onto the upper, receiving surface of the cover plate 144. As a result, a copy having copied images on both surfaces is obtained.

When all of the paper sheets stocked in the paper stock means 140 are discharged, step n-6 is followed by step n-7, and the operation returns to step n-1 via steps n-4 and n-5.

Overlapping Image Forming Mode

When the overlapping image forming mode (the mode in which a copied image of a document is formed on one surface of a copying paper and then a copied image of another document is formed overlappingly on that surface) is to be performed, the switch SW2 (FIG. 10) is closed manually. In this case, step n-2 is followed by step n-45, and the display lamp L3 is turned on. Then, as in the both surface image forming mode, the aforesaid steps n-9 to n-19 are carried out and then step n-20 sets in. By performing the steps n-9 to n-19, a copying paper having a copied image formed on its one surface (upper surface) by being conveyed through the paper conveying passage 52 of the electrostatic copying apparatus 2 is introduced from the pair of discharge rollers 72 in the copying apparatus 2 into the curved reversal passage 156 through the space between the upper movable guide plate 228 and the lower guide plate 230 held at the introduction position shown by the solid line in FIG. 3 as in the both surface image forming mode. In step n-20, it is determined whether the switch SW1 is closed or not. Since in the overlapping image forming mode, the switch SW1 is opened and the switch SW2 is closed, step n-20 is followed by step n-46. In step n-46, there is waiting for a predetermined period of time. This predetermined period of time is slightly longer than the time required for the paper introduced into the curved reversal passage 156 to be fed into the paper stock means 140 through the curved reversal passage 156 as shown hereinafter and then abut at its leading edge against the front wall portion 114 of the supporting base plate 110 (i.e., the paper leading edge restricting plate). During waiting for the predetermined period of time, the paper introduced into the reversal passage 156 is conveyed through the reversal passage 156 by the action of the rollers 216, 218 and 220 rotating in the direction of arrow 174 and introduced into the paper stock means 140. It will be easily understood by referring to FIG. 3 that while the paper is conveyed through the curved reversal passage 156, the paper is turned inside out and therefore introduced into the paper stock means 140 with its one surface bearing the formed image facing downward. Since the paper is curved in the moving direction by being passed through the curved reversal passage 156, its leading edge portion tends to move upwardly in the downstream end portion of the reversal passage 156. Since, however, in the illustrated auxiliary unit 108, the guide member 160 (FIGS. 3 and 4) is disposed in the downstream end portion of the reversal passage 156, the aforesaid upward movement of the leading edge portion of the paper is surely avoided and the paper is surely introduced into the paper stock means 140 from the curved reversal passage 156.

The copying paper introduced into the paper stock means 140 is further advanced by the action of the carry-in roller 286 and its leading edge is caused to abut against the front wall portion 114 of the supporting base plate 110. Thereafter, the aforesaid steps n-26 to n-38 are carried out, and as in the both surface image forming mode, the widthwise position of the paper fed into the paper stock means 140 is restricted as is required. If desired, during the waiting for the predetermined time in step n-46 and after the leading edge of the paper has advanced to a position downstream of the movable restricting plate 376 or 396, the actuating means 390 or 404 may be energized several times temporarily to hold the movable restricting plate 376 or 396 several times temporarily at the operating position shown by the two-dot chain line in FIGS. 6 and 9, and thus perform a pre-operation for the operation of restricting the widthwise direction of the paper.

After the required number of copying paper sheets having the JIS B5 size or the JIS A4 size has been stocked in the paper stock means 140 in the manner described above, the switch SW3 (FIG. 10) is manually closed as in the both surface image forming mode (whereupon the switch SW2 closed up to that time is opened). Consequently, as in the both surface image forming mode, the aforesaid steps n-41 to n-44 are carried out via step n-39 or n-40.

After the movable supporting plate piece 262 has been elevated as shown by the two-dot chain line in FIG. 3 and the uppermost paper of the paper layer on the movable supporting plate piece 262 is pressed elastically against the delivery roller 104 of the electrostatic copying apparatus 2, the delivery roller 104 is rotated counterclockwise in FIG. 3 by, for example, closing a copying switch (not shown) provided in the electrostatic copying apparatus 2 as in the both surface image forming mode described hereinabove. As a result, the uppermost copying paper is discharged from the paper stock means 104 through the outlet portion 142, introduced into the paper feed passage 96 (FIG. 1) of the copying apparatus 2 and introduced into the paper conveying passage 52 through the paper feed passage 96. It will be readily undetstood by referring to FIG. 1 that during conveyance through the curved paper feed passage 96, the copying paper turned inside out as a result of passing through the curved reversal passage 156 as described above is again turned inside out. Accordingly, the copying paper is conveyed through the paper conveying passage 52 with its one surface already bearing the copied image facing upward, and during this time, an image of another document is overlapping formed on the aforesaid one surface (upper surface) of the copying paper. Thereafter, the copying paper is guided from the pair of discharge rollers 72 to the upper surface of the upper movable guide plate 228 held at the non-introduction position shown by the two-dot chain line in FIG. 3 and discharged onto the upper, receiving surface of the cover plate 144. As a result, a copy having an overlapping copied image formed on one surface thereof is obtained.

When all the copying paper sheets stocked in the paper stock means 140 are discharged as stated above, step n-6 is followed by step n-7 and then the operation returns to step n-1 via steps n-4 and n-5, as in the both surface image forming mode.

Treatment of the Paper that has Jammed Up

When jamming of the paper occurs in the inlet portion 136, the curved reversal passage 156 or the short-circuit passage 158 within the auxiliary unit 108, the cover plate 144 is opened to the position shown by the two-dot chain line in FIG. 3. This permits very easy removal of the paper that has jammed up. When jamming occurs in the paper stock means 140 or the outlet portion 142, the auxiliary unit 108 is moved to the left in FIG. 3 and detached from the copying apparatus 2. Then the cover plate 254 is opened to the position shown by the two-dot chain line in FIG. 3. This permits very easy removal of the paper that has jammed up. Paper jamming can be detected by a jam detecting means (not shown) which may be of any suitable type known per se.

Unique control in the Electrostatic Copying Apparatus

In the embodiments described hereinabove, the control method is simplified by establishing controlling of the electrostatic copying apparatus 2 and controlling of the auxiliary unit 108 independently from each other without exchanging control signals between the copying apparatus 2 and the auxiliary unit 108. In view of the fact that the copying paper cassette 94 and the auxiliary unit 108 are selectively mounted detachably on the electrostatic copying apparatus 2, a unique control system is employed in the copying apparatus 2 in addition to the ordinary copying operation control system. This unique control system will be described in detail below.

With reference to FIG. 1, the electrostatic copying apparatus 2 has provided therein a first, a second and a third paper detecting means S1, S2 and S3. The first paper detecting means S1 is disposed in the paper feed means 76 and detects whether or not a copying paper exists in the paper feed means 76, or more specifically, whether or not a paper sheet is placed on the paper placing table 78 of the paper feed means 76. The first paper detecting means S1 may be constructed of a microswitch known per se (or a reflection-type or transmission-type photosensor, etc.). The second paper detecting means S2 is disposed in relation to the space 86 into which the paper cassette 94 or the auxiliary unit 108 is selectively loaded, and detects whether or not a copying paper sheet exists in the paper cassette 94 when the cassette 94 is loaded in the space 86, and whether or not copying paper sheets are fed into and stocked in the paper stock means 140 when the auxiliary unit 108 is loaded in the space 86. The second paper detecting means S2 may be constructed of a reflection-type photosensor known per se. The paper detecting means S3 is disposed in the downstream end portion of the paper conveying passage 52, and detects the paper which goes past it. The third paper detecting means S3 may be constructed of a microswitch known per se (or a reflection-type or transmission-type photosensor, etc.).

Figure 13:
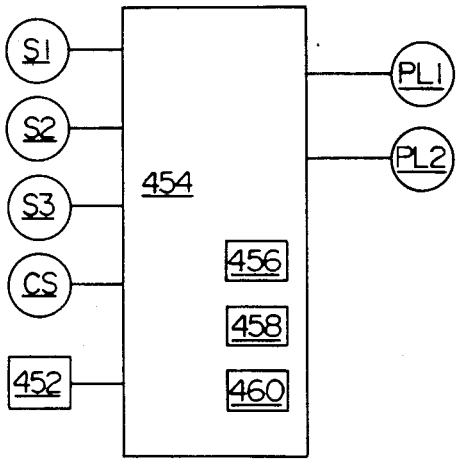
FIG. 13 is a block diagram showing main control elements provided in the electrostatic copying apparatus shown in FIG. 1.

With reference to FIG. 13, the electrostatic copying apparatus 2 also has provided therein a copying operation start switch means CS and a required copy number setting means 452. The copying operation start switch CS is disposed on an operating panel (not shown) provided on the upper surface or front surface of the housing 4 of the electrostatic copying apparatus, and is temporarily closed by the operator when starting the copying action of the electrostatic copying apparatus 2. The required copy number setting means 452 includes an input means disposed on the operating panel (the input means may be constructed of 10 keys corresponding to the numerals 0 to 9. The operator can set the required number of copies from a single document by operating the input means. The operating panel also has disposed therein a lamp PL1 for displaying the presence or absence of a copying paper sheet and a lamp PL2 for displaying paper jamming. An operation control means 454 which can be constructed from a microprocessor is also provided in the copying apparatus 2. The operation control means 454 has built therein a copy number counting means 456 composed of a counter, a time measuring means 458 composed of a timer, and a discriminating means 460 composed of flags. The operation control means 454 controls the operations of the various elements of the copying apparatus 2, and thus controls the copying operation of the copying apparatus 2.

With reference mainly to FIGS. 14-A, 14-B and 14-C which are flow chartsshowing the unique control sequence by the operation control means 454, it is determined in step m-1 whether or not the copying operation start switch means CS has been closed. When the strat switch means CS has been closed, step m-2 sets in, and it is determined whether or not the first paper detecting means S1 has detected paper, and therefore whether or not exists in the second paper feed means 76. When there is no paper in the paper feed means 76, step m-3 sets in, and it is determined whether or not the second paper detecting means S2 has detected paper. When the auxiliary unit 108 is loaded in the copying apparatus 2, no copying operation is carried out at the time of step m-3, and no copying paper has been fed into the paper stock means 140 of the auxiliary unit 108. Hence, the second paper detecting means S2 does not detect any paper. When the paper cassette 94 is loaded in the copying apparatus 2 but no paper exists in it, the second paper detecting means S2 does not detect paper. When in step m-3, the second paper detecting means S2 does not detect paper, step m-4 sets in. In step m-4, the paper absence displaying lamp PL1 is turned on to warn the operator that the copying operation cannot be carried out because no paper exist. Then, the operation returns to m-1.

On the other hand, when the paper cassette 94 is loaded in the copying apparatus 2 and paper exists in the paper cassette 94, the second paper detecting means S2 detects paper in step m-3. In this case, step m-3 is followed by step m-5. In step m-5, a third paper feed mode in which the delivery roller 104 is rotated to introduce paper from the paper cassette 94 into the paper conveying passage 52 through the paper feed passage 96 is established, and the copying operation is carried out. It will be easily understood that by this copying operation, the ordinary image forming mode is performed, and an ordinary copy having a copied image of a single document formed on its one surface is obtained. Then, step m-6 sets in, and it is determined whether or not paper jamming has occurred. Occurrence of paper jamming can be determined on the basis of the detection of paper by the third paper detecting means S3, or more specifically, by whether within a predetermined period of time from the delivery of paper from the paper cassette, the third paper detecting means S3 has once detected paper but later fails to detect paper (namely whether the paper goes past the third paper detecting means S3 and is discharged onto the receiver tray 84). When paper jamming has occurred, step m-7 sets in, and in step m-7, the paper jamming displaying lamp PL2 is turned on. Consequently, the operator is warned of paper jamming, and the operator can accordingly remove the paper that has jammed up. Then, the operation returns to step m-1. On the other hand, it is confirmed in step m-6 that no paper jamming has occurred, step m-8 sets in, and in step m-8, the copy number counter means 456 counts up by one. Then, step m-9 sets in, and in step m-9, it is determined whether the counted value of the copy number counter means 456 is equal to the preset value of the required copy number setting means 452. When the counted value is smaller than the preset value, step m-5 again sets in and the next copying operation is carried out in the third paper feed mode. On the other hand, the operation of producing the required number of copies has been carried out and the counted value is equal to the preset value in step m-9, step 10 sets in. In step m-10, the copy number counter means 456 is reset (namely, the counted value is returned to zero). Then, step m-11 sets in, and the required copy number setting means 452 is reset (namely, the preset value is returned to 1). After this initial condition is attained, the operation returns to step m-1.

When in step m-2 the first paper detecting means S1 detects paper, namely when paper exists in the paper feed means 76, step m-2 is followed by step m-12. In step m-12, it is determined as in step m-3 whether the second paper detecting means S2 detects paper. When the paper cassette 94 is loaded in the copying apparatus 2 and paper exists in the cassette 94 and therefore the second paper detecting means detects paper, step m-5 sets in, and as stated above, the third paper feed mode is established and the copying operation is carried out. Hence, in the illustrated embodiment, when the paper cassette 94 is loaded in the copying apparatus 2 and paper exists in the cassette 94, the third paper feed mode of delivering paper from the cassette 94 is established prior to first and second paper feed modes to be described, and the copying operation in accordance with an ordinary image forming mode is carried out irrespective of whether paper exists in the paper feed means 76.

When the second paper detecting means S2 does not detect paper in step m-12 (and therefore, the auxiliary unit 108 is loaded in the copying apparatus 2, or the paper cassette 94 is loaded in the copying apparatus 2 but no paper exists in the cassette 94), step m-13 sets in. In step m-13, a first paper feed mode in which paper is fed from the paper feed means 76 into the paper conveying passage 96 is established, and the copying operation is carried out. Accordingly, in the illustrated embodiment, the first paper feed mode is established prior to the second paper feed mode to be described, and the copying operation is carried out. In the copying opration in the first paper feed mode, a copied image is formed on one surface of paper while the paper is conveyed from the paper feed means 76 through the paper conveying passage 52. When the auxiliary unit 108 is loaded in the copying apparatus 2 and the upper movable guide plate 228 in its inlet portion 136 is held at the introduction position shown by the solid line in FIG. 3 (and therefore in the first cycle of the image forming step in the both surface image forming mode or the overlapping image forming mode), the above paper is introduced into the auxiliary unit 108 from the paper conveying passage 52 and stocked in the paper stock means 140 in the auxiliary unit 108. Step m-13 is followed by step m-14, and in step m-14, it is determined whether or not the time measuring means 458 built in the operation control means 454 has completed time measuring. Since the time measuring means 458 starts time measuring in step m-19 to be described, it has not yet completed measuring at the time of carrying out the first cycle of the copying operation in the first paper feed mode, and thus step m-15 sets in. In step m-15, it is determined whether or not paper jamming has occurred. Occurrence of paper jamming can be determined as in step m-6 on the basis of the detection of paper by the thrid paper detecting means, or more specifically, by whether within a predetermined period of time from the delivery of paper from the paper feed means 76, the third paper detecting means S3 has once detected paper but later fails to detect it (namely whether the paper has gone past the third paper detecting means S3 and is introduced into the auxiliary unit 108, or discharged onto the cover plate 144 of the auxiliary unit 108 or the receiver tray 84). When paper jamming has occurred, step m-16 sets in, and in step m-16, paper jamming displaying lamp PL2 is turned on to warn the operator of paper jamming. The operator can accordingly remove the paper that has jammed up. Thereafter, step m-37 sets in, and in step m-37, it is determined whether the copying operation start switch CS is closed or not. When the start switch CS is closed, the operation returns to step m-13. On the other hand, it is confirmed in step m-15 that no paper jamming has occurred, step m-17 sets in, and the copying number counter means 456 counts up by one. Then, step m-18 sets in, and it is determined whether or not the counted value of the copy number counter means 456 is 1, namely whether or not the copying operation has been carried out through one cycle in the first paper feed mode. When the counted value of the counter means 456 is 1, step m-19 sets in. In step m-19, the time measuring means 458 starts time measuring. The time measuring means 458 completes time measuring after it has measured a predetermined time. The predetermined period of time is set at a time period corresponding to (for example, slightly longer than) the time required from the time when the trailing edge of the copying paper has gone past the third paper detecting means S3 (namely the time when the time measuring means 458 has started measuring) in the state where the auxiliary unit 108 is loaded in the copying apparatus 2 and the upper movable guide plate 228 of its inlet portion 136 is held at the introduction position shown by the solid line in FIG. 3 until the paper introduced into the auxiliary unit 108 is fed to the paper stock means 140 through the curved reversal passage 156 or from the curved reversal passage 156 via the short-circuit passage 158. Thereafter, step m-20 sets in. When the counted value of the counter means 456 is larger than 1 in step m-18, step m-18 is followed by step m-20 without going through step m-19. In step m-20, it is determined whether or not the counted value of the copy number counting means 456 is equal to the preset value of the required copy number setting means 452. When the counted value is smaller than the preset value, the operation returns to step m-13, and the next copying operation is carried out in the first paper feed mode. When after step m-13, step m-14 again sets in, the time measuring means 458 which started measuring in step m-19 has already measured the aforesaid predetermined period of time. Hence, step m-14 is then followed by step m-21. In step m-21, it is determined whether the second paper detecting means S2 detects paper. When the auxiliary unit 108 is loaded in the copying apparatus 2 and the upper movable guide plate 228 of its inlet portion 136 is held at the introduction position shown by the solid line in FIG. 3 in order to perform the both surface image forming mode or the overlapping image forming mode, the first paper is fed into, and stocked in, the paper stock means 140 of the auxiliary unit 108 before the time measuring means 458 has completed time measuring. Hence, the second paper detecting means S2 detects paper. In this case, step m-22 sets in, and in step m-22, the discriminating means 460 built in the operation control means 454 is set. Then, step m-23 sets in, and the time measuring means 458 which has completed measuring is reset. Thereafter, step m-15 is again sets in. In the second and subsequent cycles of the copying operation in the first paper feed mode, step m-18 is followed by step m-20 without going through step m-19, and therefore, the time measuring means 458 does not start measuring. In the third and subsequent cycles of the copying operation in the first paper feed mode, step m-14 is followed by step m-15 without going to step m-21. On the other hand, when the second paper detecting means S2 does not detect paper in step m-21, namely in the case of the ordinary image forming mode instead of the both surface image forming mode or the overlapping image forming mode, step m-23 sets in without going to step m-22 and therefore without setting the discriminating means 460. When the paper cassette 94 is loaded in the copying apparatus and paper exists in the paper cassette 94, the second paper detecting means S2 also detects paper. But in such a case, step m-12 or step m-3 is followed by step m-5, and therefore step m-21 does not set in. Accordingly, the detection of paper by the second paper detecting means S2 in step m-21 means that the auxiliary unit 108 is loaded in the electrostatic copying apparatus 2 and the paper stock means 140 of the auxiliary unit 108 has paper stocked therein.

When the required number of copies has been produced by the above copying operation in the first paper feed mode, the counted value of the copy number counter means 456 becomes equal to the preset value of the required copy number setting means 452 in step m-20. In this case, step m-20 is followed by step m-24 where the copy number counter means 456 is reset. Then, step m-25 sets in, and it is determined whether or not the discriminating means 460 is set in step m-22, namely whether or not the copying mode is the both surface image forming mode or the overlapping image forming mode. When the discriminating means 460 is not set, namely when the copying mode is an ordinary image forming mode, step m-26 sets in, and in step m-26, the required copy number setting means 452 is reset. Thus, after the initial state has been attained, step m-1 again sets in. On the other hand, when the discriminating means 460 is set in step m-22, and therefore when the copying mode is a both surface image forming mode or an overlapping image forming mode, step m-27 sets in and it is determined whether or not the copying operation start switch means CS is closed. When the operator places a document to be copied on the other surface of paper in the both surface image forming mode or a document to be overlappingly copied in the overlapping image forming mode on the stationary transparent plate 6 of the electrostatic copying apparatus 2 and closes the copying operation start switch means CS, step m-28 sets in. In step m-28, the second paper feed mode in which the delivery roller 104 is rotated to introduce paper from the paper stock means 140 of the auxiliary unit 108 into the paper conveying passage 52 through the paper feed passage 96 is established, and the copying operation is carried out. In this copying operation, another copied image is formed on the other surface of the paper bearing a copied image on one surface (in the both surface image forming mode), or another copied image is overlappingly formed on the one surface of the paper on which a copied image has already been formed (in the case of the overlapping image forming mode). Step m-28 is thus followed by step m-29, and in step m-29, it is determined whether or not paper jamming has occurred. As in the case of steps m-6 and m-15, whether paper jamming has occurred is determined on the basis of the detection of paper by the third paper detecting means S3, or more specifically by whether within a predetermined period of time from the delivery of the paper from the paper stock means 140 of the auxiliary unit 108 has once detected paper but later fails to detect it (namely whether or not the paper had gone past the third paper detecting means S3 and is discharged onto the cover plate 144 of the auxiliary unit 108). In the event of paper jamming, step m-30 sets in, and in step m-30, the paper jamming displaying lamp PL2 is turned on. Thus, the operator is warned of paper jamming, and the operator can accordingly remove the paper that has jammed up. Thereafter, the operation returns to step m-27. On the other hand, when it is confirmed in step m-28 that no paper jamming has occurred, step m-31 sets in, and the counted value of the copy number counter means 456 counts up by one. Then, step m-32 sets in, and it is determined whether or not the counted value of the copy number counter means 456 is equal to the preset value of the required copy number setting means 452. When the counted value is smaller than the preset value, step m-33 sets in, and it is determined whether or not the second paper detecting means S2 detects paper. Usually, when the counted value is smaller than the preset value in step m-32, paper sheets in a number obtained by subtracting the counted value from the preset value remain in the paper stock means 140 of the auxiliary unit 108, and therefore, the second paper detecting means S2 detects paper. In this case, step m-28 again sets in, and the next copying operation is carried out in the second paper feed mode.

When the required number of copies has been produced by the copying operation in the second paper feed mode and therefore the counted value of the copy number counter means 456 becomes equal to the preset value of the required copy number setting means 452 in step m-32, step m-32 is followed by step m-34 where the discriminating means 460 is reset. Then, step m-26 sets in, and in step m-26, the required copy number setting means 452 is reset. Thus, the initial state is attained, and thereafter, the operation returns to step m-1.

On the other hand, when paper jamming occurs in the copying apparatus 2 in the copying operation in the third paper feed mode, or when in the copying operation in the second paper feed mode, no paper jamming occurs in the copying apparatus 2 but paper jamming has occurred in the auxiliary unit 108 (occurrence of paper jamming in the auxiliary unit 108 can be detected by a suitable method in the control operation in the auxiliary unit 108 itself), the counted value of the copy number counter means 456 is smaller than the preset value of the required copy number setting means 452 in step m-32, and therefore in spite of the fact that step m-32 is followed by step m-33, no paper remains in the paper stock means 140 of the auxiliary unit 108 if a number obtained by subtracting the counted value from the preset value is equal to the number of paper sheets that have jammed up. Hence, the second paper detecting means S2 does not detect paper. In this case, step m-33 is followed by step m-35, and in step m-35, the preset value of the required copy number setting means 452 is changed to a value obtained by subtracting the counted value from the originally preset value to make up for the paper sheets which have jammed up. Then, step m-36 sets in, and the discriminating means 460 is reset. Thereafter, the operation returns to step m-1. Accordingly, the operator can additionally perform the both surface image forming mode or the overlapping image forming mode without the need for counting the number of paper sheets which have jammed up, and for re-setting the required copy number setting means 452 at a value including the additionally required number of paper sheets.

In the illustrated embodiment, controlling of the electrostatic copying apparatus 2 and controlling of the auxiliary unit 108 are established independently from each other without exchanging control signals between the copying apparatus 2 and the auxiliary unit 108. Since the unique control method described above is employed in the electrostatic copying apparatus 2, the first to third paper feed modes are properly selected and set. Accordingly, the ordinary image forming mode and the both surface image forming mode and/or the overlapping image-forming mode can be selectively carried out very easily and accurately without the need for any additional complex manual operation.

While the present invention has been described hereinabove in detail with reference to preferred embodiments by referring to the accompanying drawings, it should be understood that the invention is not limited to these specific embodiments, and various changes and modifications are possible without departing from the scope of the invention described and claimed herein.

What we claim is:

1. An auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage having a downstream end connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage;

said auxiliary unit comprising an inlet portion adapted to be connected to the downstream end of the paper conveying passage, an outlet portion adapted to be connected to the upstream end of the paper feed passage, copying paper stock means located adjacent to the outlet portion, a copying paper moving passage disposed between the inlet portion and the paper stock means, and a copying paper receiving surface located adjacent to the inlet portion; an introduction control member disposed in the inlet portion and adapted to be selectively held at an introduction position at which said introduction control member guides the paper discharged from the downstream end of the paper conveying passage to the paper moving passage and a non-introduction position at which said introduction control member guides the paper to the receiving surface, so that when the introduction control member is held at the introduction position, the paper discharged from the downstream end of the paper conveying passage is introduced into the paper moving passage, then fed into the paper stock means, and thereafter introduced again into the paper conveying passage via the outlet portion and the paper feed passage, and when the introduction control member is held at the non-introduction position, the paper discharged from the downstream end of the paper conveying passage is gathered at the paper receiving surface; said auxiliary unit further comprising a pair of discharge rollers disposed in the downstream end portion of the paper conveying passage and a pair of introduction rollers disposed in the upstream end portion of the paper moving passage, the paper receiving surface being disposed above the paper moving passage, an upper movable guide plate constituting the introduction control member and a lower guide plate cooperating with the upper movable guide plate when the upper movable guide plate is at the introduction position, said upper and lower guide plate being disposed between the pair of discharge rollers and the pair of introduction rollers, so that when the upper movable guide plate is held at the introduction position, the upstream end of the upper movable guide plate is positioned above the nipping site of the pair of discharge rollers and the downstream end of the upper movable guide plate is positioned above the nipping site of the pair of introduction rollers and below the paper receiving surface whereby the paper discharged from the nipping site of the pair of discharge rollers is guided to the nipping site of the pair of introduction rollers through the space between the upper movable guide plate and the lower guide plate, and when the upper movable guide plate is held at the non-introduction position, the upstream end of the upper movable guid plate is positioned below the nipping site for the pair of discharge rollers and the downstream end of the upper movable guide plate is positioned on substantially the same level as, or above, the paper receiving surface whereby the paper discharged from the nipping site of the pair of discharge rollers is guided to the paper receiving surface by the upper surface of the upper movable guide plate.

2. The auxiliary unit of claim 1 wherein the upper movable guide plate is mounted such that it can freely pivot between the introduction position and the non-introduction position about an axis extending substantially perpendicularly to the paper moving direction.

3. The auxiliary unit of claim 1 wherein at least the upstream portion of the lower guide plate is made of a flexible material, and when the upper guide plate is held at the non-introduction position, the upstream portion of the lower guide plate is pressed by the upstream portion of the upper guide plate and bent downwardly.

4. The auxiliary unit of claim 1 wherein a cover plate is disposed adjacent to the inlet portion such that it can move freely between a closed position and an open position, at least the upstream portion of the paper moving passage is defined below the cover plate when the cover plate is at the closed position, and at least a greater portion of at least the upstream portion of the paper moving passage is opened when the cover plate is held at the open position, and the paper receiving surface is defined by the upper surface of the cover plate when the cover plate is at the closed position.

5. The auxiliary unit of claim 4 wherein the upper roller in the introduction roller pair is mounted on the under surface of the cover plate.

6. The auxiliary unit of claim 4 wherein a plurality of upper defining plates defining the upper side of the paper moving passage are mounted on the uder surface of the cover plate.

7. An auxiliary unit for, and capable of being detachably mounted on, an electrostaic copying apparatus said electrostatic copying apparatus comprising a copying paper conveying passage, a copying paper feed means for feeding a copying paper to the paper conveying passage and a copying paper feed passage having a downstream end connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage;

said auxiliary unit comprising an inlet portion adapted to be connected to the downstream end of the paper conveying passage, an outlet portion adapted to be connected to the upstream end of the paper feed passage, copying paper stock means located adjacent to the outlet portion, a cover plate disposed adjacent to the inlet portion and freely movable between a closed position and an open position, a paper moving passage disposed between the inlet portion and the paper stock means, at least the upstream portion of the paper moving passage being defined below the cover plate when the cover plate is at the closed position, and at least a greater portion of at least the upstream portion of the moving passage being opened when the cover plate is held at the open position, a paper receiving surface defined by the upper surface of the cover plate when the cover plate is at the closed position, a plurality of upper defining plates defining the upperside of the paper moving passage and mounted on the under surface of the cover plate, an introduction control member disposed in the inlet portion, said introduction control member being adapted to be selectively held at an introduction position, at which said introduction control member guides the paper discharged from the downstream end of the paper conveying passage to the paper moving passage, and a non-introduction position, at which said introduction control member guides said paper to the recieving surface, so that when the introduction control member is held at the introduction position, the paper discharged from the downstream end of the paper conveying passage is introduced into the paper moving passage, then fed into the paper stock means, and thereafter introduced again into the paper conveying passage via the outlet portion and the paper feed passage, and when the introduction control member is held at the nonintroduction position, the paper discharged from the downstream end of the paper conveying passage is gathered at the paper receiving surface.

8. The auxiliary unit of claim 7 wherein a pair of introduction rollers are disposed in the upstream end portion of the paper moving passage, and the upper roller of the introduction roller pair is mounted on the under surface of the cover plate.

9. An auxiliary unit for, and capable of bing detachabley mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage; wherein said auxiliary unit comprises an inlet portion adapted to be connected to the downstream end of the paper conveying passage, an outlet portion adapted to be connected to the upstream end of the paper feed passage, a copying paper stock means located adjacent to the outlet portion, a copying paper moving passage disposed between the inlet portion and the paper stock means, and a paper moving means for feeding the paper discharged from the paper conveying passage and introduced into the paper moving passage through the inlet portion into the paper stock means, the paper moving passage includes a curved reversal passage extending from the inlet portion to the paper stock means and a short-circuit passage connecting the upstream end portion of the curved reversal passage to the paper stock means, the paper moving means selectively performs a first moving mode by which the paper is turned inside out by passing it through the curved reversal passage and then fed into the paper stock means, and a second moving mode by which the copying paper is introduced into the curved reversal passage and then moved in the reverse direction and fed into the paper stock means from the upstream end portion of the curved reversal passage through the short-circuit passage, and the paper fed to the paper stock means is again introduced into the paper conveying passage through the outlet portion and the paper feed passage.

10. The auxiliary unit of claim 9 wherein the copying paper is turned inside out by introducing it into the paper conveying passage through the paper feed paassage.

11. The auxiliary unit of claim 9 wherein the paper moving means includes a reverse direction moving means disposed in the upstream portion of the curved reversal passage and being rotatably in a direction to move the paper in said reverse direction, and a pressing means adapted to be selectively held at an operating position at which it cooperates with the reverse direction moving means and a non-operating position at which it is kept apart from the reverse direction moving means, and when the pressing means is at the non-operating position, the paper does not undergo the reverse direction moving action of the reverse direction moving means, and when the pressing means is held at the operating position, the paper is pressed against the reverse direction moving means by the pressing means and moved in the reverse direction by the cooperative action of the reverse direction moving means and the pressing means.

12. The auxiliary unit of claim 11 wherein the reverse direction moving means is constructed of a roller to be driven.

13. The auxiliary unit of claim 11 wherein the pressing means is constructed of a follower roller mounted rotatably.

14. The auxiliary unit of claim 9 wherein the upstream end of the short-circuit passage is positioned below the downstream end of the inlet portion, the paper moving means includes a multifunctional conveying means for introducing the paper into the curved reversal passage from its upstream end and introducing the paper into the short-circuit passage from its upstream end, and the multifunctional conveying means has an upper supporting shaft, an intermediate supporting shaft and a lower supporting shaft disposed in vertically spaced relationship, and an upper conveyor roller, an intermediate conveyor roller and a lower conveyor roller mounted respectively on the upper supporting shaft, intermediate supporting shaft and lower supporting shaft, the intermediate conveyor roller and the upper conveyor roller cooperating with each other to define the upstream end of the curved reversal passage and introduce the paper into the curved reversal passage from its upstream end, and the intermediate conveyor roller and the lower conveyor roller cooperating with each other to define the upstream end of the short-circuit passage and introduce the paper into the short-circuit passage from its upstream end.

15. The auxiliary unit of claim 14, wherein the multifunctional conveying means further includes a plurality of intermediate protrusions which are disposed in the intermediate conveyor roller at circumferentially spaced intervals, project radially beyond the circumferential surface of the intermediate conveyor roller and are rotated together with the intermediate conveyor roller.

16. The auxiliary unit of claim 15 wherein the intermediate protrusions are formed of a flexible material.

17. The auxiliary unit of claim 15 wherein the multifunctional conveying means further includes a plurality of lower protrusions which are disposed in the lower conveyor roller at circumferentially spaced intervals and are rotated together with the lower conveyor roller.

18. The auxiliary unit of claim 17 wherein the lower protrusions are formed of a flexible material.

19. The auxiliary unit of claim 17 wherein the intermediate protrusions and the lower protrusions are disposed alternately in the widthwise direction.

20. An auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage; wherein said auxiliary unit comprises an inlet portion adapted to be connected to the downstream end of the paper conveying passage, an outlet portion adapted to be connected to the upstream end of the paper feed passage, a copying paper stock means located adjacent to the outlet portion, a copying paper moving passage disposed between the inlet portion and the paper stock means, and a paper moving means for feeding the paper discharged from the paper conveying passage and introduced into the paper moving passage through the inlet portion into the paper stock means, the paper moving passage includes a curved reversal passage extending from the inlet portion to the paper stock means and a short-circuit passage connecting the upstream end portion of the curved reversal passage to the paper stock means, the paper moving means selectively performs a first moving mode by which the paper is turned inside out by passing it through the curved reversal passage, and fed into the paper stock means and a second moving mode by which the copying paper is once introduced into the curved reversal passage and then moved in the reverse direction and fed into the paper stock means from the upstream end portion of the curved reversal passage through the short-circuit passage, the curved reversal passage has an upstream portion, a curved intermediate portion curved downwardly and a downstream portion extending below the upstream portion, the short-circuit passage extends from the upstream end portion of the curved reversal passage above the downstream end portion of the curved reversal passage, a guide plate along the upper surface of which the copying paper is moved is disposed in the downstream end portion of the curved reversal passage, at least one guide member extending from its one end mounted pivotably in the moving direction of the paper passing through the curved reversal passage and having a free end biased in a direction to abut against the guide plate is mounted above the guide plate, the paper moved in the downstream end portion of the curved reversal passage advances below the guide member, and the paper moved through the short-circuit passage advances above the guide member and the copying paper fed into the paper stock means is again introduced into the paper conveying passage through the outlet portion and the paper feed passage 21. The auxiliary unit of claim20 wherein the guide member is biased by its own weight in such a direction in which its free end abuts against the guide plate.

22. The auxiliary unit of claim 20 wherein a plurality of such guide members are disposed in widthwise spaced relationship.

23. An auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage; wherein said auxiliary unit comprises an inlet portion adapted to be connected to the downstream end of the paper conveying passage, an outlet portion adapted to be connected to the upstream end of the paper feed passage, a copying paper stock means located adjacent to the outlet portion, a copying paper moving passage disposed between the inlet portion and the paper stock means, and a paper moving means for feeding the paper discharged from the paper conveying passage and introduced into the paper moving passage through the inlet portion into the paper stock means, the paper stock means includes a copying paper supporting plate extending in the moving direction of the copying paper, a paper leading edge restricting plate disposed ahead of the paper supporting plate and projecting upwardly beyond the upper surface of the paper supporting plate, and a carry-in roller mechanism, the carry-in roller mechanism comprises a carry-in roller biased downwardly and mounted so that it can freely ascend and descend between the lowermost position at which it abuts against the upper surface of the paper supporting plate and the uppermost position spaced a predetermined distance from the upper surface of the paper supporting plate, and an elevating means adapted to be selectively energized to elevate the carry-in roller to the uppermost position, when the paper is fed into the paper stock means from the paper moving passage, the elevating means is in the deenergized state, and the paper fed into the paper stock means advances into a position below the carry-in roller along the upper surface of the paper supporting plate, then further advances by the delivering action of the carry-in roller and abuts at its leading edge against the paper leading edge restricting plate whereby the advancing of the paper is hampered, and thereafter the elevating means is energized to elevate the carry-in roller to the uppermost position and keep it away from the paper, and the paper fed into the paper stock means is again introduced into the paper conveying passage through the outlet portion and the paper feed passage.

24. The auxiliary unit of claim 23 wherein the carry-in roller mechanism includes a carry-in roller supporting member disposed above the paper supporting plate, said supporting member extending in the moving direction of the paper from its one end pivotably mounted, and the carry-in roller is mounted pivotably on the free end portion of the supporting member and elevated or lowered by the pivoting movement of the supporting member.

25. The auxiliary unit of claim 24 wherein the carry-in roller is biased elastically downwardly.

26. The auxiliary unit of claim 23 wherein the paper stock means further includes main holding members disposed on both sides of the carry-in roller in the widthwise direction, and each of the main holding members is biased downwardly and mounted such that it can be freely elevated from its lowermost position at which it abuts against the upper surface of the paper supporting plate.

27. The auxiliary unit of claim 26 wherein each of the main holding members extends in the paper moving direction from its one end pivotably mounted above the paper supporting plate and its free end portion abuts against the upper surface of the paper supporting plate, and each holding member is elevated and lowered by its pivotal movement.

28. The auxiliary unit of claim 27 wherein the main holding members are biased downwardly by their own weight.

29. The auxiliary unit of claim 26 wherein the carry-in roller and the main holding members are disposed in the rear portion of the paper stock means, and the paper stock means further includes at least one subsidiary holding member disposed in the front portion of the paper stock means, said subsidiary holding member being biased downwardly and mounted such that it can be freely elevated from its lowermost position at which it abuts against the upper surface of the paper supporting plate.

30. The auxiliary unit of claim 29 wherein the subsidiary holding member extends in the paper moving direction from its one end pivotably mounted above the paper supporting plate and its free end portion abuts against the upper surface of the paper supporting plate, and the subsidiary holding member is elevated or lowered by its pivotal movement.

31. The auxiliary unit of claim 30 wherein the subsidiary holding member is biased downwardly by its own weight.

32. An auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage; wherein said auxiliary unit comprises an inlet portion adapted to be connected to the downstream end of the paper conveying passage, an outlet portion adapted to be connected to the upstream end of the paper feed passage, a copying paper stock means located adjacent to the outlet portion, a copying paper moving passage disposed between the inlet portion and the paper stock means, and a paper moving means for feeding the paper discharged from the paper conveying passage and introduced into the paper moving passage through the inlet portion into the paper stock means, the paper stock means includes a copying paper supporting plate extending in the paper moving direction, a paper leading edge restricting plate disposed ahead of the paper supporting plate and projecting upwardly beyond the upper surface of the paper supporting plate, and a carry-in roller mechanism which acts on the copying paper fed from the paper moving passage and advancing along the upper surface of the paper supporting plate to further advance the paper and cause its leading edge to abut against the paper leading edge restricting plate, at least the front edge portion of the paper supporting plate is opened at its top and constitutes said outlet portion, and a delivery roller provided in the electrostatic copying apparatus and adapted to be selectively rotated is positioned against the outlet portion, at least the front portion of the paper supporting plate is constructed of a movable supporting plate piece mounted for free elevation from a receiving position spaced downwardly a predetermined distance from the delivery roller, and the paper stock means further includes an elastic biasing means for elastically biasing the movable supporting plate piece selectively upwardly, and when the movable supporting plate piece is elastically biased upwardly by the elastic biasing means, the uppermost paper on the movable supporting plate piece is elastically pressed by the delivery roller, and thus when the delivery roller is rotated, the uppermost paper on the movable supporting plate piece is delivered to the paper feed passage through the outlet portion.

33. The auxiliary unit of claim 32 wherein the rear end portion of the movable supporting plate piece is mounted pivotably and can pivot upwardly from the receiving position.

34. The auxiliary unit of claim 32 wherein the elastic biasing means includes a push-up member having one end pivotably mounted, a movable member mounted such that it can be selectively held at a non-operating position and an operating position, a tension spring stretched between the push-up member and the movable member and an actuating means for selectively holding the movable member at the non-operating position and the operating position, and when the movable member is held at the non-operating position, the push-up member is positioned such that its free end portion is in contact with, or below, the under surface of the movable supporting plate piece at the receiving position, but when the movable member is held at the operating position, the push-up member is pivoted via the tension spring in a direction in which its free end portion is elevated, whereby the free end portion of the push-up member acts on the under surface of the movable supporting plate piece to elevate the movable supporting plate piece elastically.

35. The auxiliary unit of claim 34 wherein the movable member is mounted rotatably through the non-operating position and the operating position, the actuating means includes a spring clutch means for drivingly connecting a rotary driving source and the movable member selectively, and the spring clutch means is selectively controlled to a first linking-cancelled condition in which the linking of the rotating drive source and the movable member is cancelled while the movable member is at the non-operating position and a second linking-cancelled condition in which the linking of the rotating drive source and the movable member is cancelled while the movable member is at the operating position.

36. An auxiliary unit for, and capable of being detachably mounted on, an electrostatic copying apparatus, said electrostatic copying apparatus comprising a copying paper conveying passage, a copying paper feed means for feeding a copying paper to the paper conveying passage and a copying paper feed passage whose downstream end is connected to the paper conveying passage, and said electrostatic copying apparatus being adapted to form a copied image on one surface of the copying paper while the paper introduced into the paper conveying passage from the paper feed means or the paper feed passage is conveyed through the paper conveying passage; wherein said auxiliary unit comprises an inlet portion adapted to be connected to the downstream end of the paper conveying passage, an outlet portion adapted to be connected to the upstream end of the paper feed passage, a copying paper stock means located adjacent to the outlet portion, a copying paper moving passage disposed between the inlet portion and the paper stock means, and a paper moving means for feeding the paper dischargedfrom the paper conveying passage and introduced into the paper moving passage through the inlet portion into the paper stock means, the paper stock means includes a copying paper supporting plate extending in the paper moving direction, a paper leading edge restricting plate disposed in ahead of the paper supporting plate and projecting upwardly beyond the upper surface of the paper supporting plate, a one paper side edge restricting plate disposed on one side of the paper supporting plate and projecting upwardly beyond the upper surface of the paper supporting plate, a carry-in roller mechanism which acts on the copying paper fed from the paper moving passage and advancing along the upper surface of the paper supporting plate to further advance the paper and cause its leading edge to abut against the paper leading edge restricting plate, and a widthwise moving mechanism for moving the copying paper widthwise toward the paper one side edge restricting plate and causing one side edge of the paper to abut substantially against the one paper side edge restricting plate, the widthwise moving mechanism includes an opening formed on the paper supporting plate, a movable restricting plate mounted for free pivoting between an operating position at which it projects upwardly through the opening and a non-operating position at which it recedes outwardly in the widthwise direction from the operating position, and an actuating means for selectively moving the movable restricting plate to the operating position and the non-operating position, and when the movable restricting plate is moved from the non-operating position to the operating position, the movable restricting plate acts on the other side edge of the paper to move the paper widthwise toward the one paper side edge restricting plate, and the copying paper fed into the paper stock means is again introduced into the paper conveying passage through the outlet portion and the paper feed passage.

37. The auxiliary unit of claim 36 wherein the carry-in roller mechanism includes a carry-in roller biased downwardly and mounted for free ertical movement between the lowermost position at which it abuts against the upper surface of the paper supporting plate and the uppermost position at which it is spaced a predetermined distance from the upper surface of the paper supporting plate and an elevating means adapted to be selectively energized to elevate the carry-in roller to the uppermost position, and when the copying paper is fed into the paper stock means from the paper moving passage, the movable restricting plate is held at the non-operating position and the elevating means in the deenergized state and the paper fed into the paper stock means advances to a position beneath the carry-in roller along the upper surface of the paper supporting plate and then by the delivering action of the carry-in roller, further advances and abuts at its leading edge against the paper leading edge restricting plate whereby the advancing of the paper is hampered, and thereafter the elevating means is energized to elevate the carry-in roller to the uppermost position and keep it away from the paper, and the movable restricting plate is moved to the non-operating position.

38. The auxiliary unit of claim 36 wherein the actuating means of the widthwise moving mechanism is constructed of an electromagnetic solenoid; and when the magnetic solenoid is energized, the movable restricting plate is moved to the operating position from the non-operating position, and when the electromagnetic solenoid is deenergized, the movable restricting plate is elastically moved to the non-operating position from the operating position.

39. The auxiliary unit of claim 36 wherein the paper stock means includes a plurality of widthwise moving mechanism disposed at different positions in the widthwise direction, the movable restricting plates of at least those widthwise moving mechanisms other than one disposed outermost in the widthwise direction do not project beyond the upper surface of the paper supporting plate when held at the non-operating position, and either one of the widthwise moving mechanisms is actuated according to the width of the paper fed into the paper stock means.

40. A combination of an electrostatic copying apparatus comprising a copying paper conveying passage, a copying paper feed means for feeding a copying paper to the paper conveying passage and a copying paper feed passage whose downstream end is connected to the paper conveying passage and being adapted to form a copied image on one surface of the copying paper while the paper introduced into the paper conveying passage from the paper feed means or the paper feed passage is conveyed through the paper conveying passage, with an auxiliary unit detachably mounted on the electrostatic copying apparatus and comprising a copying paper moving passage whose upstream end is selectively connected to the downstream end of the paper conveying passage of the copying apparatus and a paper stock means whose upstream end is connected to the downstream end of the paper moving passage and whose downstream end is connected to the upstream end of the paper feed passage of the copying apparatus, wherein the copying paper introduced into the paper conveying passage from the paper feed means of the copying apparatus and conveyed through the paper conveying passage is selectively introduced into the paper moving passage of the auxiliary unit, then fed into the paper stock means of the auxiliary unit, and thereafter introduced into the paper conveying passage of the copying apparatus from the paper stock means of the auxiliary unit through the paper feed passage of the copying apparatus; characterized in that the electrostatic copying apparatus includes a first copying paper detecting means for detecting paper in the paper feed means, a second copying paper detecting means for detecting paper fed into the paper stock means of the auxiliary unit, a required number setting means, a copy number counting means and an operation control means, when the first paper detecting means detects paper, the operation control means establishes a first copying paper feed mode in which the paper is introduced into the paper conveying passage from the paper feed means prior to a second copying paper feed mode in which the paper is introduced into the paper conveying passage from the paper stock means of the auxiliary unit via the paper moving passage, the copy number counting means counts up according to the performance of the copying operation of the electrostatic copying apparatus and is reset after the counted value of the counting means became equal to a preset value in the required copy number setting means, and the operation control means establishes the second paper feed mode in place of the first paper feed mode when the counted value of the copy number counting means becomes equal to the preset value in the required copy number setting means in the first paper feed mode and the second paper detecting means detects

41. The combination of claim 40 wherein the electrostatic copying apparatus further includes a copying operation start switch means, and the operation control means starts the copying operation of the electrostatic copying apparatus by the closing of the copying operation start switch means, and stops the copying operation when the counted value of the copy number counting means becomes equal to the preset value in the required number setting means.

42. The combination of claim 40, wherein the electrostatic copying apparatus further includes a third copying paper detecting means for detecting paper passing through the downstream end portion of the paper conveying passage, and the copy number counting means counts up on the basis of the detection of paper by the third paper detecting means.

43. The combination of claim 40 wherein the combination further includes a copying paper cassette which can be detachably loaded into the electrostatic copying apparatus in place of the auxiliary unit, the second paper detecting means can also detect paper in the paper cassette, the electrostatic copying apparatus further includes a time measuring means and a discriminating means adapted to be set in either a normal condition or a condition allowing the second paper feed mode, the time measuring means starts to measure time based on the detection of the first paper by the first paper detecting means in the first paper feed mode and finishes time measuring after the lapse of a predetermined period of time corresponding to the time required from the start of time measuring until the paper is fed into the paper stock means of the auxiliary unit when the auxiliary unit is loaded in the electrostatic copying apparatus, the discriminating means changes from the normal condition to the second paper feed mode allowing condition only when the second paper detecting means detects paper after the finishing of time measuring by the time measuring means although before the time measuring means finishes time measuring the second paper detecting means does not detect paper, and the operation control means establishes the second paper feed mode only when the discriminating means is in the condition allowing the second paper feed mode.

44. The combination of claim 43 wherein the operation control means determines after the finishing of time measuring by the time measuring means whether or not the second paper detecting means detects paper, and thereafter resets the time measuring means.

45. The combination of claim 44 wherein the operation control means returns the condition of the discriminating means to the normal condition when in the second paper feed mode established, the second paper detecting means does not detect paper in spite of the fact that the counted value of the copy number counting means is smaller than the preset value of the required copy number setting means.

46. The combination of claim 43 wherein when the second paper detecting means detects paper before the start of the copying operation, the operation control means establishes a third copying paper feed mode in which the paper is introduced into the paper conveying passage from the paper cassette through the paper moving passage prior to the first and second paper feed mode.

47. The combination of claim 40 wherein when the second paper detecting means does not detect paper in the second paper feed mode established in spite of the counted value of the copy number counting means being smaller than the preset value of the required copy number setting means, the operation control means changes the preset value of the required copy number setting means to a value obtained by subtracting the counted value of the copy number counting means from the preset value of the required copy number means, and establishes the first paper feed mode in place of the second paper feed mode.

* * * * *

UNITED STATES PATENT AND TRADEMARK OFFICE

CERTIFICATE OF CORRECTION

PATENT NO. : 4,766,467

DATED : August 23, 1988

INVENTOR(S) : Shuji Yamada, Tetsuya Matsushita and Hironori Andou

It is certified that error appears in the above-identified patent and that said Letters Patent is hereby corrected as shown below:

In the claims:

Column 44, line 57 (claim 37), "ertical" should be --vertical--.

Column 46, line 24 (claim 40), after "detects", --paper.-- should be inserted.

Signed and Sealed this

Twenty-eighth Day of February, 1989

*Attest:*

DONALD J. QUIGG

*Attesting Officer*

*Commissioner of Patents and Trademarks*